US011253824B1

(12) United States Patent
Gerakopulos et al.

(10) Patent No.: US 11,253,824 B1
(45) Date of Patent: Feb. 22, 2022

(54) APPARATUS, METHODS, AND SYSTEMS FOR MIXING AND DISPERSING A DISPERSED PHASE IN A MEDIUM

(71) Applicant: Nanoquan Inc., Kitchener (CA)

(72) Inventors: Ryan Gerakopulos, Kitchener (CA); The Nam Long Doan, Kitchener (CA)

(73) Assignee: Trusscore Inc., Palmerston (CA)

( * ) Notice: Subject to any disclaimer, the term of this patent is extended or adjusted under 35 U.S.C. 154(b) by 398 days.

(21) Appl. No.: 16/370,419

(22) Filed: Mar. 29, 2019

Related U.S. Application Data

(60) Provisional application No. 62/649,949, filed on Mar. 29, 2018.

(51) Int. Cl.
*B01F 3/12* (2006.01)
*B01F 7/16* (2006.01)
*B01F 7/00* (2006.01)

(52) U.S. Cl.
CPC ..... *B01F 7/00008* (2013.01); *B01F 3/1221* (2013.01); *B01F 7/161* (2013.01); *B01F 7/1635* (2013.01); *B01F 2215/005* (2013.01)

(58) Field of Classification Search
CPC ..... B01F 4/221; B01F 4/334; B01F 4/335; B01F 4/336; B01F 4/338; B01F 5/334; B01F 5/336; B01F 5/335; B01F 5/221; B01F 7/00008; B01F 3/1221; B01F 7/1635; B01F 7/161; B01F 2215/005
See application file for complete search history.

(56) References Cited

U.S. PATENT DOCUMENTS 1,462,485 A * 7/1923 Denison ..... B01F 5/16 366/178.3
1,853,682 A * 4/1932 Hechenbleikner .... B01F 7/1625 239/223
2,042,880 A * 6/1936 Cornell ..... B01F 5/22 366/136
2,203,673 A * 6/1940 Cornell ..... C11B 3/06 366/169.2
2,273,835 A * 2/1942 Cornell ..... B01F 5/226 366/169.2
2,324,824 A * 7/1943 Cornell ..... E01C 19/45 366/264
2,555,899 A * 6/1951 Pernthaler ..... B01F 5/22 366/263
2,955,956 A * 10/1960 Baugh ..... B01J 2/30 427/215
3,017,854 A * 1/1962 O'Brien ..... B01J 2/006 118/303
3,033,159 A * 5/1962 O'Brien ..... B05B 3/1007 118/303
3,186,803 A * 6/1965 Akaboshi ..... B01F 5/22 422/136

(Continued)

*Primary Examiner* — Tony G Soohoo
(74) *Attorney, Agent, or Firm* — Bereskin & Parr LLP

(57) ABSTRACT

A method for mixing and dispersing an internal phase and an external phase in a liquid compound. The method includes preparing the compound by combining the internal phase of the compound and the external phase of the compound, the external phase of the compound being a liquid, forming a film of the compound by depositing a first volume of the liquid compound on a rotating surface and collecting the film as a dispersed liquid compound on a collection surface.

14 Claims, 19 Drawing Sheets

(56) References Cited

U.S. PATENT DOCUMENTS 3,347,620 A * 10/1967 Yamashita ..... B01J 10/02 423/608
3,400,915 A * 9/1968 Onishi ..... B01F 5/223 366/290
3,457,047 A * 7/1969 Yamashita ..... C08B 11/12 422/198
3,473,896 A * 10/1969 Halder ..... C07C 39/235 422/205
3,544,079 A * 12/1970 Dressler ..... B01F 7/1625 366/169.1
3,744,763 A * 7/1973 Schnoring ..... B01F 5/0451 366/178.1
3,801,326 A * 4/1974 Claes ..... B01F 7/00816 430/642
3,934,859 A * 1/1976 Deve ..... B22C 5/02 366/170.4
3,998,433 A * 12/1976 Iwako ..... B01F 7/00758 366/178.3
4,080,210 A * 3/1978 Asada ..... B01F 5/22 366/168.1
4,096,587 A * 6/1978 Haller ..... B22C 5/02 366/40
4,175,873 A * 11/1979 Iwako ..... B01F 5/26 366/165.3
4,999,131 A * 3/1991 Shimizu ..... B01F 3/0807 366/168.1
5,018,871 A * 5/1991 Brazelton ..... B01F 7/00275 366/169.1
5,035,991 A * 7/1991 Ichikawa ..... G03C 1/015 430/569
5,096,690 A * 3/1992 Saito ..... B01F 7/164 422/209
5,213,772 A * 5/1993 Ichikawa ..... C01G 5/02 422/252
5,690,428 A * 11/1997 Bryan ..... B01F 5/0645 366/172.1
5,728,511 A * 3/1998 Hirosawa ..... G03C 1/14 430/356
5,939,247 A * 8/1999 Hirosawa ..... G03C 7/39244 430/607
5,975,440 A * 11/1999 Watson ..... B29B 7/429 241/18
6,431,742 B2 * 8/2002 Mori ..... B01F 7/00208 366/171.1
6,435,707 B1 * 8/2002 Mori ..... B01F 5/223 366/171.1
6,443,611 B1 * 9/2002 Hasberg ..... B01F 7/00758 366/172.1
6,513,965 B2 * 2/2003 Hasberg ..... B01F 7/00758 366/168.1
6,513,968 B2 * 2/2003 Schembri ..... B01F 13/0059 366/101
6,972,113 B1 * 12/2005 Ramshaw ..... B01F 5/22 422/135
8,092,073 B2 * 1/2012 Asplund ..... B01F 3/188 366/136
9,777,132 B2 * 10/2017 Kverel ..... C09D 163/00
2003/0122111 A1 * 7/2003 Glatkowski ..... C09D 5/24 252/500
2006/0228435 A1 * 10/2006 Andrady ..... D04H 3/016 425/174.8 R
2016/0067632 A1 * 3/2016 Ponzielli ..... B29B 7/52 96/155

* cited by examiner

APPARATUS, METHODS, AND SYSTEMS FOR MIXING AND DISPERSING A DISPERSED PHASE IN A MEDIUM

TECHNICAL FIELD

The embodiments disclosed herein relate to composite dispersions, and, in particular to apparatus, methods, and systems for mixing and dispersing a dispersed phase in a medium.

BRIEF DESCRIPTION OF THE DRAWINGS

The drawings included herewith are for illustrating various examples of articles, methods, and apparatuses of the present specification. In the drawings.

DETAILED DESCRIPTION

Various apparatuses or processes will be described below to provide an example of each claimed embodiment. No embodiment described below limits any claimed embodiment and any claimed embodiment may cover processes or apparatuses that differ from those described below. The claimed embodiments are not limited to apparatuses or processes having all of the features of any one apparatus or process described below or to features common to multiple or all of the apparatuses described below. It is possible that an apparatus or process described below is not an embodiment of any claimed invention. Any invention disclosed below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
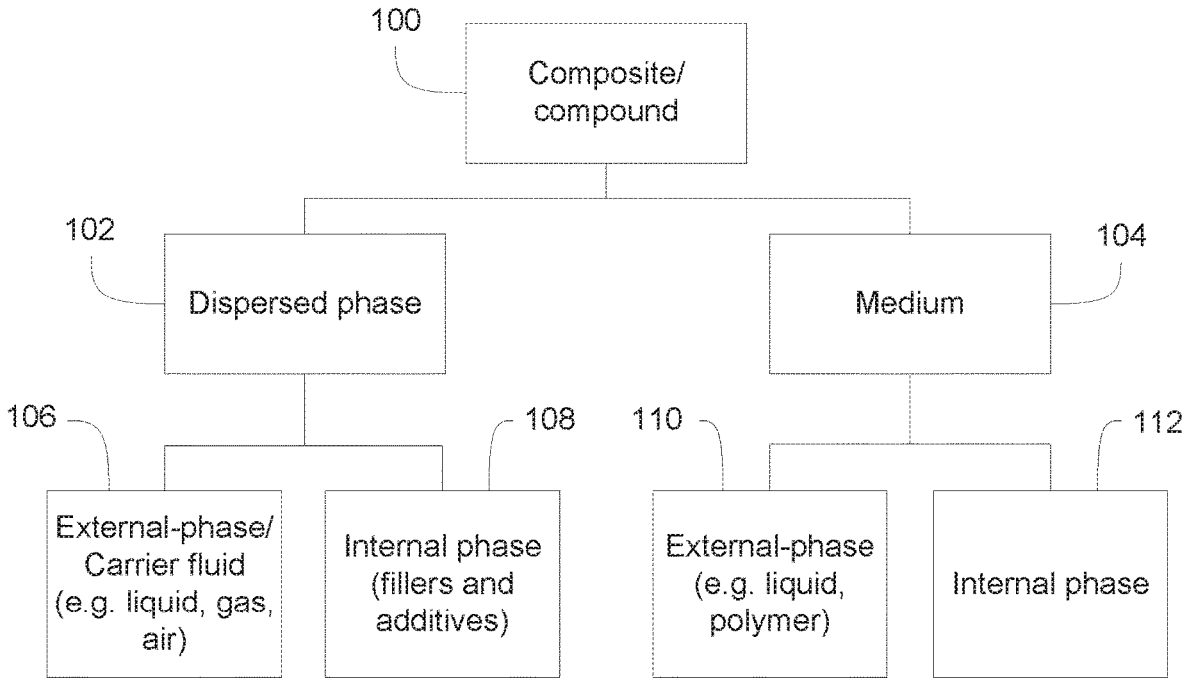
FIG. 1 is an organizational diagram showing the constituent parts of a composite or compound according to some embodiments.

Referring to FIG. 1, there is a composite 100 (or compound) formed from a dispersed phase 102 and a medium 104. The composite 100 is formed by the dispersion of the dispersed phase 102 into the medium 104 as will be further described below.

The dispersed phase 102 can be prepared from an external phase 106 (e.g a carrier fluid) and, in some cases, an internal phase 108 (e.g. fillers and/or additives).

A carrier fluid 106 is a fluid that is miscible or immiscible with the medium (e.g. liquid, colloid, polymer solution, liquid polymer, polymer melt). For instance, gas, air, and solvents (which can include liquids that are in a supercritical state, e.g. supercritical $CO_2$) may be used as the carrier fluid 106.

Fillers 108 may include both micro and nano objects that exist or are induced (e.g. during mixing or during atomization) in defined singular form that have at least one dimension in nano or micro scale. For example: particles have three dimensions in the nano/micro scale; fibers and tubes have two dimensions in the nano/micro scale; and plates and flakes have one dimension that is in the nano/micro scale. Thus, for example, a nano flake can be measured on the nanoscale in only one dimension, and a micro particle can be measured on the micro scale in all three spatial dimensions. Fillers may include any of particles, rods, tubes, wires, fibers, flakes, sheets, and platelets in respect of microstructures and/or nanostructures as determined in one, two, or three dimensions. Furthermore, fillers may take the form of a liquid, gas, or solid.

In some cases, induced fillers can be formed during dispersion. Induced fillers may include any of particles, rods, tubes, wires, fibers, flakes, sheets, and platelets in respect of microstructures and/or nanostructures as determined in one, two, or three dimensions. Furthermore, induced fillers may take the form of a liquid, gas, or solid. For example, an induced filler may be a nanocrystalline cellulose nanofiber.

It should be noted that mixtures can contain any combination of nano and micro objects: only nano objects; only micro objects; or both nano and micro objects.

Other additives 108, such as processing fluids and/or dispersion aids may be incorporated into the dispersed phase 102. These processing fluids may be miscible or immiscible in the carrier fluid 106. Other additives, such as surfactants and coupling agents may also be used.

Fillers and additives are generally referred to here as "objects", though the physical state of the objects may be solid, liquid, or gaseous. Generally speaking, these objects may be dispersed in relatively low viscosity carrier fluids using methods such as ultrasound sonication and high-shear mixing.

The medium 104 may comprise an external phase 110 that is a polymer or a liquid, and may also contain an internal phase 112 of fillers and/or additives similar to the dispersed phase 102 described above. The external phase 110 of the medium 104 may be a liquid (e.g. a solvent), a polymer solution, a liquid polymer, or a polymer melt.

Both the dispersed phase 102 and the medium 104 may be prepared (e.g. mixed) at room temperature, or at an elevated temperature (which may be above or below the melting temperature of the external phase of the medium), or any other temperature (e.g. below room temperature).

Figure 2:
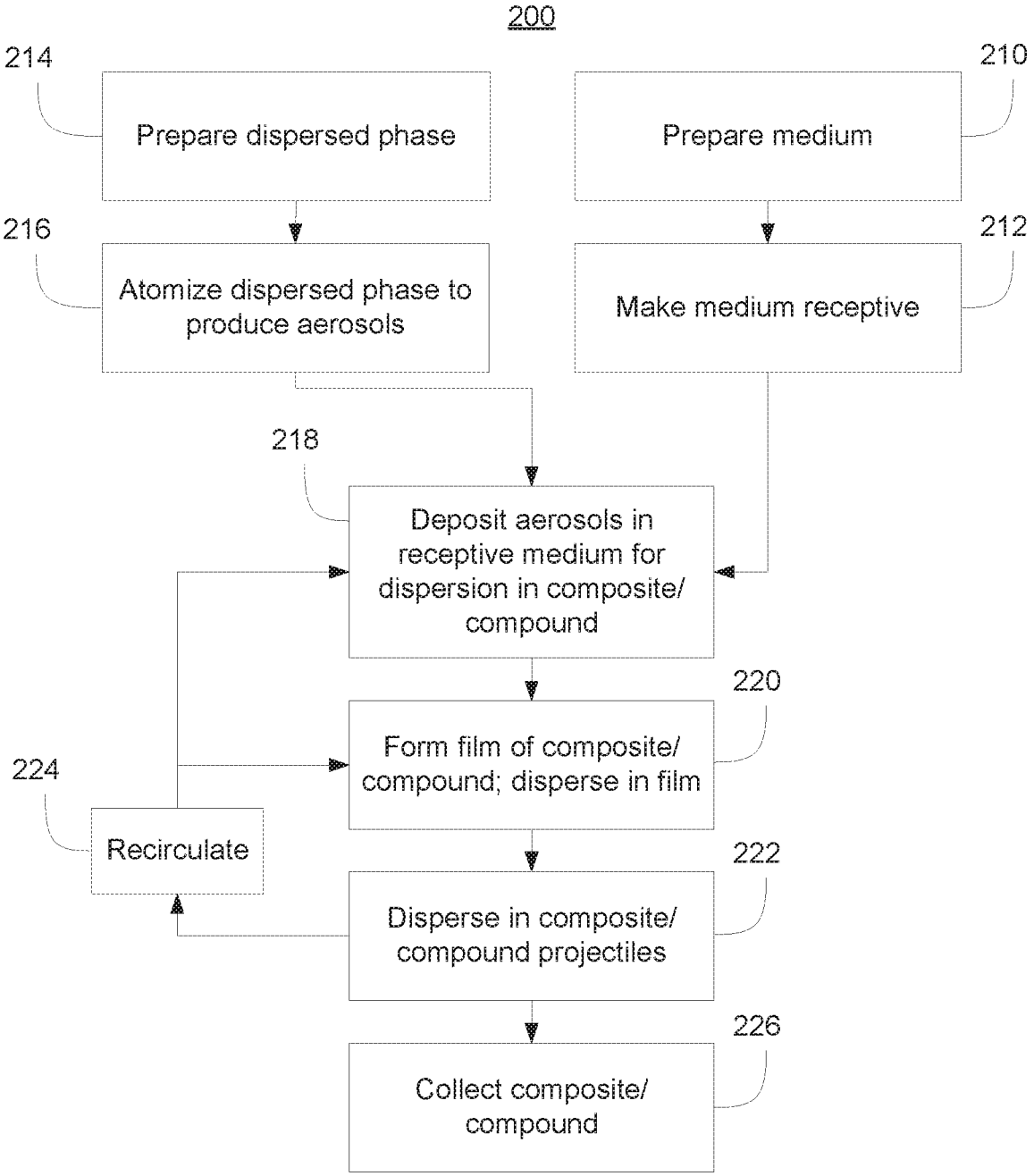
FIG. 2 is a method for mixing and dispersing a dispersed phase in a medium to produce the composite or compound of FIG. 1, according to some embodiments.

Referring to FIG. 2, there is a method 200 that provides an example of how the composite or compound 100 may be formed.

At step 210, the medium is prepared. The preparation of the medium 104 can include selecting an appropriate external phase 110 depending on the application and particular composite or compound 100 that is to be produced. In some cases, an appropriate internal phase 112 will be selected for the medium 104, while in other cases, the inclusion of an internal phase 112 in the medium 104 is not required.

At step 212, the medium 104 is made receptive so that the dispersed phase 102 can eventually be deposited into the medium 104 (or "receptive medium"). The medium can be made receptive, for example, by depositing the medium onto a rotating disk, and/or by forming a thin film or projectiles from the medium. According to some embodiments and/or compositions of the medium, the medium may be a liquid, a polymer solution, and polymer melt, etc.

In addition to preparing the medium 104, in some cases, it may be necessary to prepare the dispersed phase 102. This is done at step 214, which may be performed in prior to, in parallel to, or after the medium 104 is prepared at step 210. The preparation of the dispersed phase 102 can include selecting an appropriate external phase 106 depending on the application and particular composite or compound 100 that is to be produced. Similarly, an appropriate internal phase 108 is selected for the dispersed phase 102.

After the dispersed phase 102 has been prepared, the dispersed phase 102 is atomized at step 216 in order to produce aerosols of the dispersed phase. According to some embodiments and dispersed phase composition, the carrier fluid (e.g. solvent) may be evaporated at step 216.

As used herein, "atomizing" refers to the reduction of a substance to very fine particles, fragments, etc., which can include aerosol (which is a colloid suspension of fine solid particles or liquid droplets in a gaseous environment such as air, gas, smoke, fog, or other gaseous environments). Atomizing can include making fine particles in various environments, which can include liquids, water, molten polymers, etc.

Once the medium 104 has been made receptive, and the dispersed phase 102 has been formed into aerosols, the aerosols are deposited into the receptive medium at step 218. The deposition of the aerosolized dispersed phase 102 into the receptive medium forms the composite or compound 100; or, in some cases, forms a preliminary form of the composite or compound 100. For example, this may include spraying the dispersant on to a rotating disk.

According to some embodiments, at step 220, dispersion can be obtained by forming a film (e.g. a thin film) of the composite or compound so that dispersion can occur within the film. At step 220, carrier fluid (e.g. solvent) evaporation can occur, depending on the particular configuration and/or composition of the medium or dispersed phase.

For example, a thin film can be generated on a rotating disk, and then the dispersant can be effectively transferred into the medium such that it is efficiently distributed and dispersed within the medium.

According to some embodiments, dispersion can be obtained by forming projectiles from the composite or compound at step 222. The creation of composite/compound projectiles can be used to enhance the dispersion. According to some embodiments, this can include generating liquid ligaments at the edge of a rotating disk, and then further transferring, distributing, and/or dispersing the dispersant into the medium.

According to some embodiments, the liquid ligaments can be broken into aerosols, and/or liquid ligaments can be deformed by attenuation/drawing. This can further promote the efficient transformation, distribution, and/or dispersion of the dispersant into the medium.

According to some embodiments, at step 224, dispersion can be further enhanced by recirculating the preliminary form of the composite or compound. For example, the preliminary form of the composite or compound (from step 222) can be re-introduced with the medium at step 218, or introduced in place of the medium, so that additional deposits of the aerosolized dispersed phase can be made. Furthermore, it is possible to re-introduce the preliminary form of the composite or compound in place of the medium at step 220 in order to further enhance dispersion in the thin film and/or projectiles at step 222.

At step 226, the composite or compound 100 is collected. For example, this collection might include collecting projectiles of the composite or compound on a collection surface and/or collecting a film of the composite or compound.

According to some embodiments, applied forces (e.g. centrifugal, pressure, electric, magnetic, etc.) can subject both the dispersed phase and the receptive medium to shear and extensional flow deformation. This can promote effective mass transfer between phases for micro and nano objects that have high surface area (e.g. aerosols, thin films, ligaments, etc.).

Figure 3:
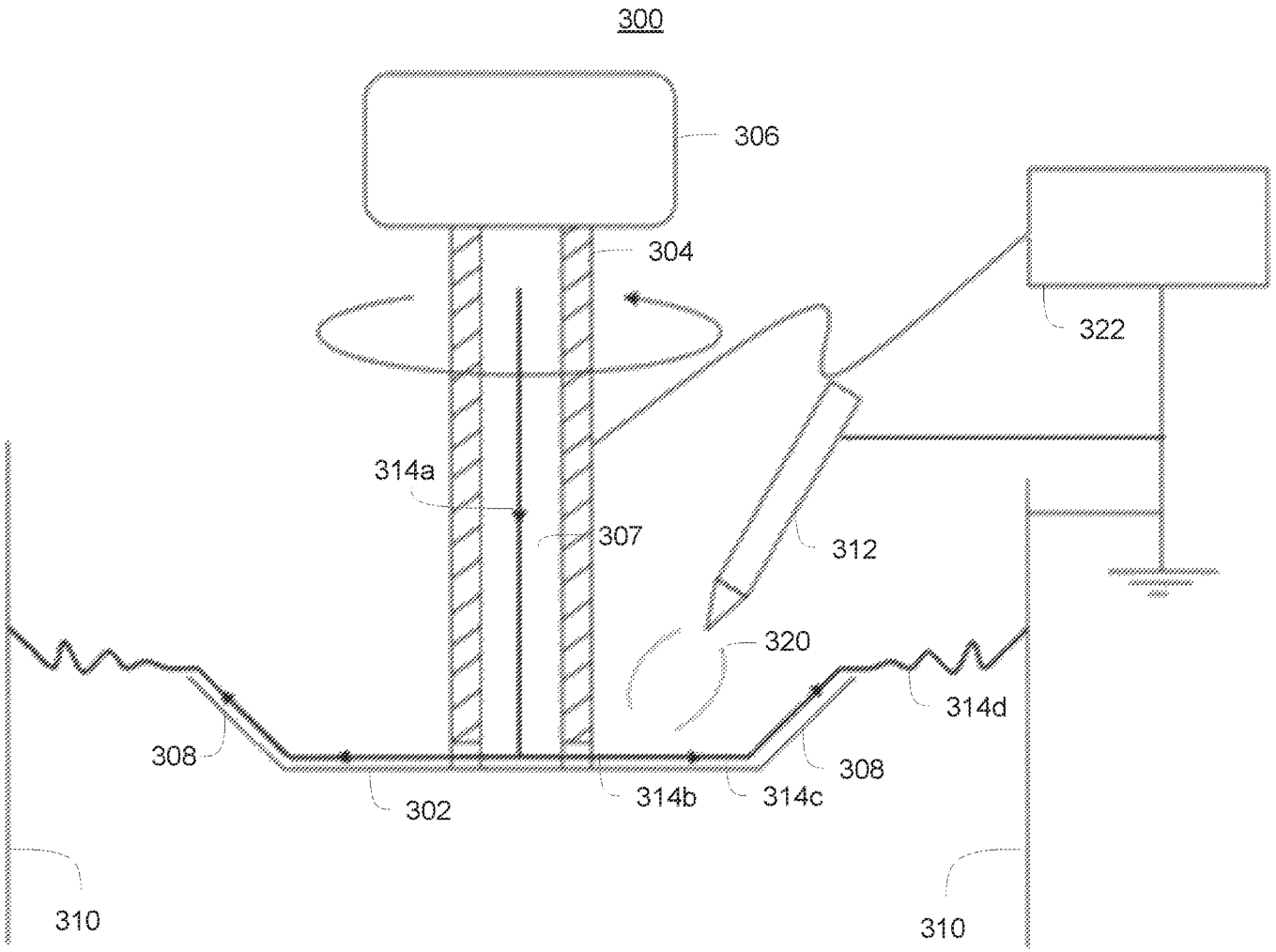
FIG. 3 is an elevation view of an apparatus for mixing and dispersing a dispersed phase in a medium, according to some embodiments.

Referring to FIG. 3, there is shown an apparatus 300 for mixing and dispersing a dispersed phase in a medium, and, in particular, an interfacial dispersion device according to some embodiments.

The apparatus comprises a rotating surface 302 that is rotated on a shaft 304 by a motor 306. The shaft includes a medium feed conduit 307 through which the medium can be applied to the rotating surface 302. The medium feed conduit 307 is shown at the center of (i.e. proximal to the center) of the rotating surface 302.

The rotating surface 302 may be of various shapes. For example, the rotating surface 302 may be flat (as shown) such as a disc. Alternatively, the rotating surface 302 may be curved, such as in the shape of a parabola, circle, ellipse, or hyperbola, in either a convex of concave manner (not shown).

The rotating surface 302 includes a transverse distal surface 308. Here, "distal" means away from the center of the rotating surface 302, and towards the edge of the rotating surface 302. The transverse distal surface 308 may extend upward and distal (away) from the rotating surface 302, as shown. In other embodiments, other orientations and shapes may be used for the transverse distal surface 308.

Distal to the transverse distal surface 308 are collecting surfaces 310. Collecting surfaces 310 may be more than one surface, or may be a single, continuous column surface surrounding the rotating surface 302.

An atomizing apparatus 312 is positioned above the rotating surface 302.

Flow paths are indicated by arrows in FIG. 3. A flow path begins when the prepared medium 314*a* is fed onto the rotating surface 302 via the medium feed conduit 307. The rotating surface 302 is rotated on the shaft 304 via the motor 306 while the medium 314*a* is fed onto the rotating surface 302.

As the rotating surface 302 rotates, a film 314*b* of the medium 314*a* is formed, which flows outwards (distal) from the center of the rotating surface 302 due to applied forces (e.g. centrifugal force). Aerosolized constituents 320 of the dispersed phase are deposited into the film 314*b* on the rotating surface 302 from the atomizing apparatus 312. This forms a composite or compound 314*c*, which continues to flow outwards towards the transverse distal surface 308.

The aerosolized constituents 320 are produced by atomizing the dispersed-phase mixture contained in the atomization apparatus 312 using techniques such as spray atomization, rotary atomization, ultrasonic spray systems, powder spray systems, chemical vapor deposition methods, electrospraying, electro-hydrodynamic spray, or other methods.

The atomization apparatus 312 may be pressurized with hydrostatic pressure or a non-zero gauge pressure to aerosolize the dispersed-phase mixture. The dispersed-phase mixture in the atomization apparatus 312 may be at room temperature or at an elevated temperature, or any other temperature. The dispersed phase can be aerosolized into ambient air, a gaseous environment, or a chemical-vapor environment that helps to functionalize the nano or micro objects before depositing them into the receptive medium 314*b*. An external air/gas velocity jet at room, or any other temperature, electric field, and magnetic field may be used to enhance the atomization of the dispersed phase, to guide the trajectory of aerosolized constituents, and/or to promote the removal or evaporation of the aerosolized constituents.

The compound film flow 314*c* is generated on the rotating surface 302, which facilitates dispersion of the compound constituents. Centrifugal force acting on the compound 314*c* causes the film to thin by application of shear and extensional flow deformation. As will be further described, according to some embodiments, the apparatus 300 may include multiple rotating surfaces 302. The rotating surface 302 can be operated at room temperature, an elevated temperature, or any other temperature.

As the flow path continues, and the compound 314*c* contacts the distal edge of the transverse distal surface 308, and projectiles 314*d* are formed. These projectiles are then collected on the collecting surface 310. The projectiles 314*d* are shown as ligaments for illustrative purposes.

The compound film 314*c* flows over the edge of the rotating surface 302 (or the edge of the transverse distal surface 308, as depicted) and gets ejected as projectiles 314*d*. An ejection location is defined as the region where the projectiles are formed at the edge of the rotating surface 302 (or transverse distal surface 308, as depicted). Once the projectiles 314*d* are ejected from the edge of the rotating surface, further object dispersion via strong extensional and shear flow deformation by several force mechanisms occurs.

An electric field may be generated between the rotating surface 302 and the collection surface 310, with the application of a high voltage 322 (e.g. a positive or negative voltage). Additionally, a magnetic field can be applied between the rotating surface 302 and the collection surface 310 to further enhance the dispersion using a permanent magnet or an electromagnet. The rotating surface 302 can also be subjected to ultrasonic vibration for better dispersion of the dispersed phase in the medium during film flow 314*c* and/or projectile formation 314*d*.

According to some embodiments, the deposition of aerosols into the receptive medium can promote the dispersion and distribution of the dispersed phase within the medium, thereby promoting effective mass transfer between the phases. For example, applied forces can result in shear and extensional flow deformation, thereby increasing the surface area between an aerosolized disperse phase and the receptive medium, such as a thin film flow 314*c* formed on the rotating surface 302, and/or projectile formation 314*d*. In such a case, projectiles (e.g. ligaments) are generated, and, additionally, projectile deformation (e.g. attenuation of ligaments, droplet breakdown, etc.) allows for further dispersion. The high surface area between the phases in projectiles promotes this dispersion.

For further clarity and understanding, the apparatus 300 is distinct from electrospraying apparatus as well as electrospinning apparatus. Electrospraying is a method that uses electrical forces to produce liquid aerosols using atomization apparatus. In electrospraying, surface tension holds the fluid droplet at an electrospraying nozzle, which then acquires an electrostatic charge due to the application of a voltage. This results in the formation of a Taylor cone. The jet flow away from the Taylor cone flows in a nearly straight line, and the travelling liquid is subjected to Rayleigh instability, which produces fine liquid aerosols.

Electrospraying can also include an electrical force used in combination with other forces such as centrifugal force and pressure. If the liquid atomization of electrospraying is done using a rotating disk, the result is rotary atomization. In some cases, it is also possible to use rotary atomization in conjunction with electrospraying. In such a case, the apparatus is configured such that an electric field is applied between the rotating element and a grounded collector plate in order to increase the efficiency or reduce the size of generated aerosols.

The use of an electrospraying apparatus also differs from the use of the apparatus 300 in that the major steps of rotary electrospraying are limited to depositing liquid on to a rotating disk, generating a thin film on the disk, generating liquid ligaments at the edge of the disk, and breaking the liquid ligaments into fine aerosols.

Furthermore, the apparatus 300 is distinct from electrospinning apparatus. Electrospinning is a process for producing continuous nanofibers (e.g. in the range of sub-micron diameter to nanometer diameter scale). Electrospinning pertains to an electrically-charged jet of polymer solution or polymer melt consists of sufficiently-long chain polymer molecules that do not break up due to Rayleigh instability. Surface tension holds a fluid droplet at the spinneret, and the fluid droplet acquires an electrostatic charge due to the application of a voltage. This results in the formation of a Taylor cone. When the Taylor cone is subjected to an electric field, the result is instability in the droplet, and the formation of a single fluid jet drawn from the head of the Taylor cone. As the jet flows away from the Taylor cone in a nearly straight line, the travelling liquid jet is subject to a variety of forces such as Coulomb force, the electric force caused by an external electric field, viscoelastic force, surface tension force, gravitational force, and air drag force, which create bending instability that draws the liquid jets into nanofibers.

The use of an electrospinning apparatus also differs from the use of the apparatus 300 in that the major steps of rotary electrospinning are limited to depositing a liquid/polymer (solution/polymer) melt onto a rotating disk, generating a thin film on the disk, generating liquid ligaments at the edge of the disk, and drawing liquid ligaments into thin nanofibers.

Figure 4:
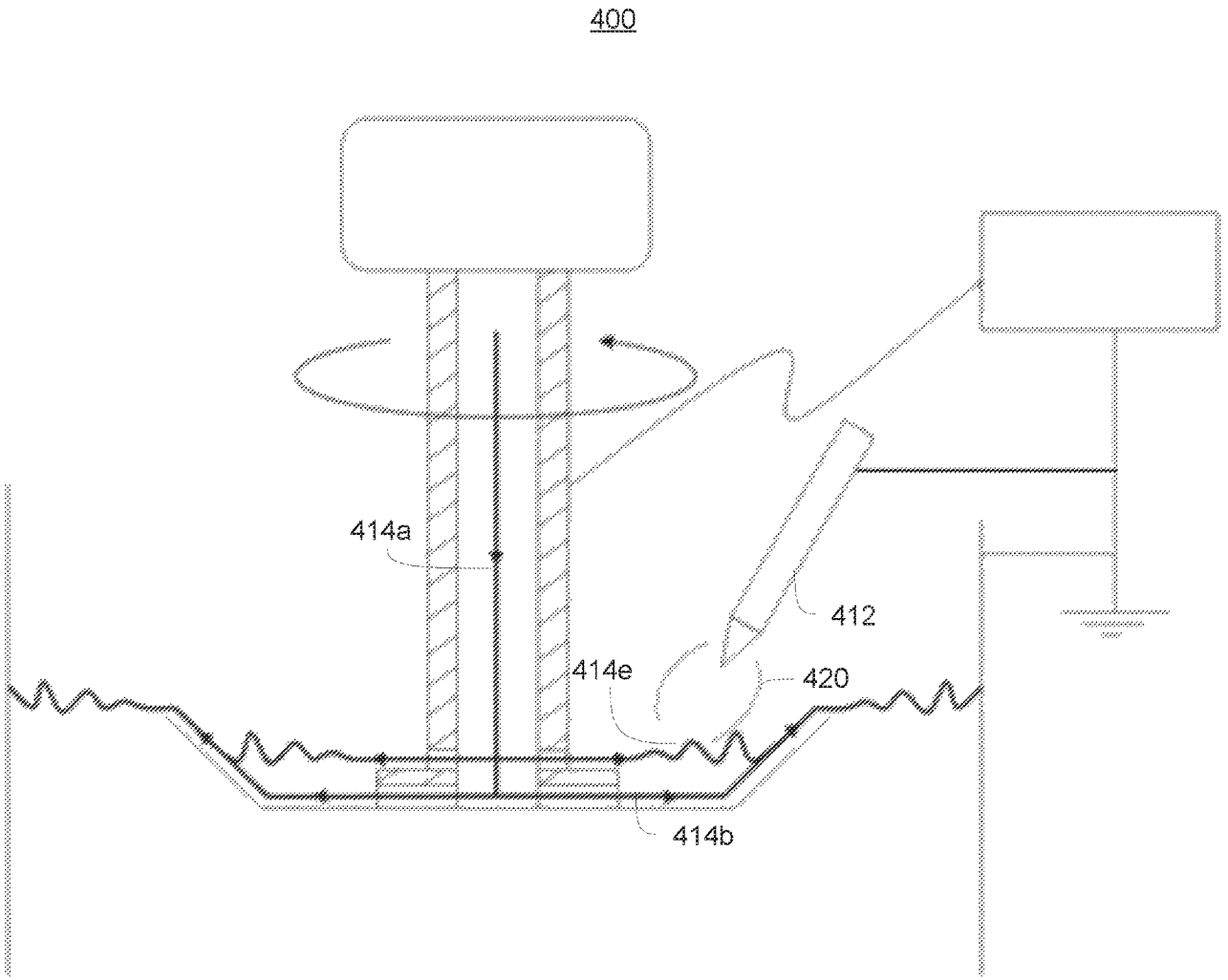
FIG. 4 is an elevation view of an apparatus for mixing and dispersing a dispersed phase in a medium, and showing a thin film and projectile path, according to some embodiments.

Referring to FIG. 4, there is shown an apparatus 400 for mixing and dispersing a dispersed phase in a medium. FIG. 4 depicts an alternate technique for using an interfacial dispersion device to make the medium receptive, according to some embodiments.

A receptive medium may be generated from a thin film 414*b* similarly to the then film 314*b* in FIG. 3. Additionally, a receptive medium may be generated from projectiles 414*e* formed from the medium 414*a*.

The aerosolized constituents 420 may be deposited from the atomizing apparatus 412 into the film 414*b* and/or the projectiles 414*e*. In this case, the film 414*b* and/or the projectiles 414*e* may both constitute the receptive medium.

Figure 5:
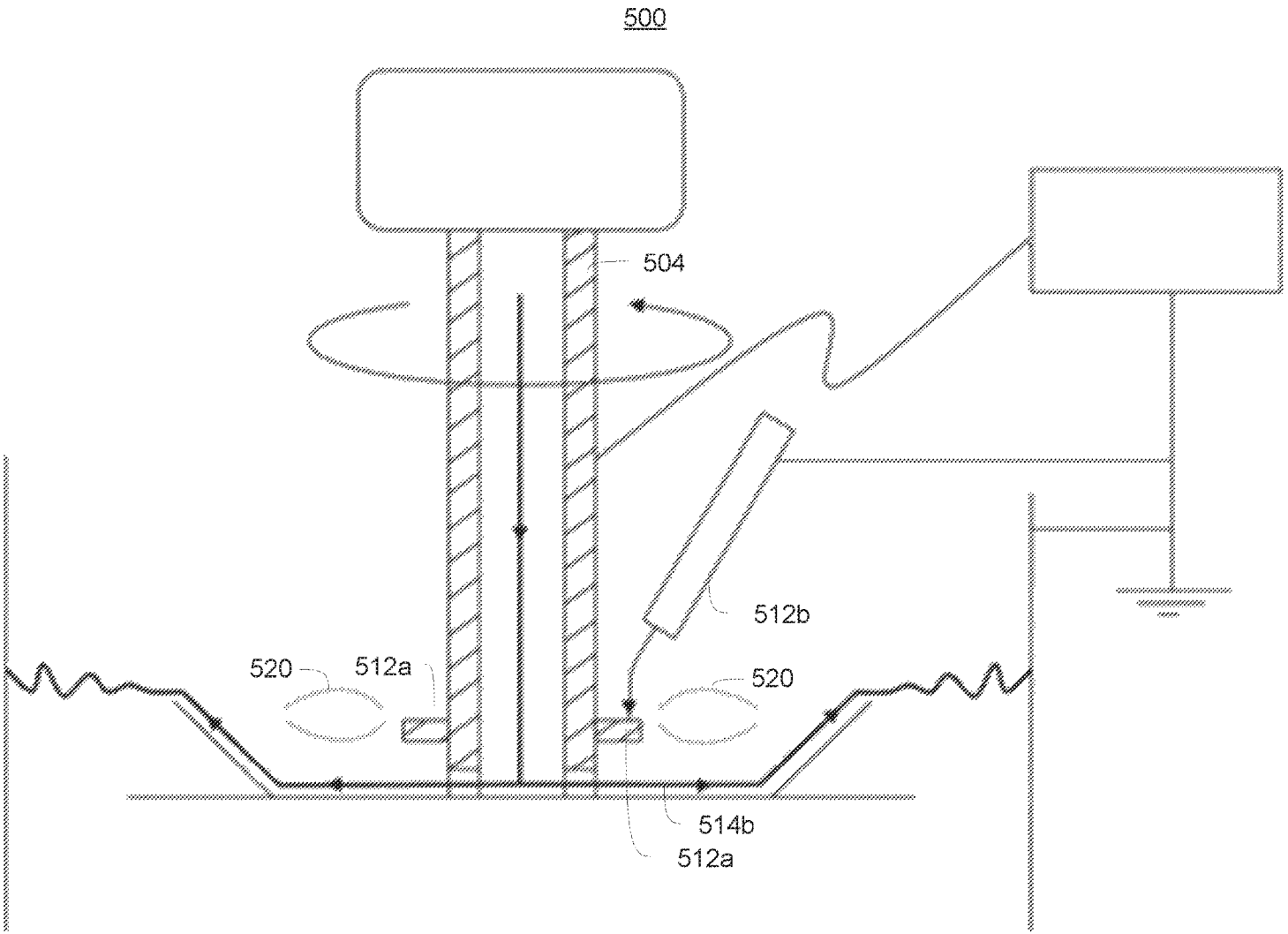
FIG. 5 is an elevation view of an apparatus for mixing and dispersing a dispersed phase in a medium, having a rotating atomizing surface, according to some embodiments.

Referring to FIG. 5, there is shown an apparatus 500 for mixing and dispersing a dispersed phase in a medium, using a rotating surface as an atomizing apparatus, according to some embodiments. FIG. 5 depicts an alternate technique for using an interfacial dispersion device to generate aerosolized constituents from the dispersed phase, according to some embodiments.

In order to produce aerosolized constituents from the dispersed phase, the dispersed-phase mixture may be deposited as a colloid/suspension onto a rotating surface 512*a* coupled to the drive shaft 504. The dispersed-phase mixture may be deposited from an ejector 512*b*, which may or may not include atomization itself.

The rotating surface 512*a* aerosolizes the dispersed-phase mixture and can be used to generate aerosolized constituents that are then deposited into the receptive medium 514*b*.

Figure 6:
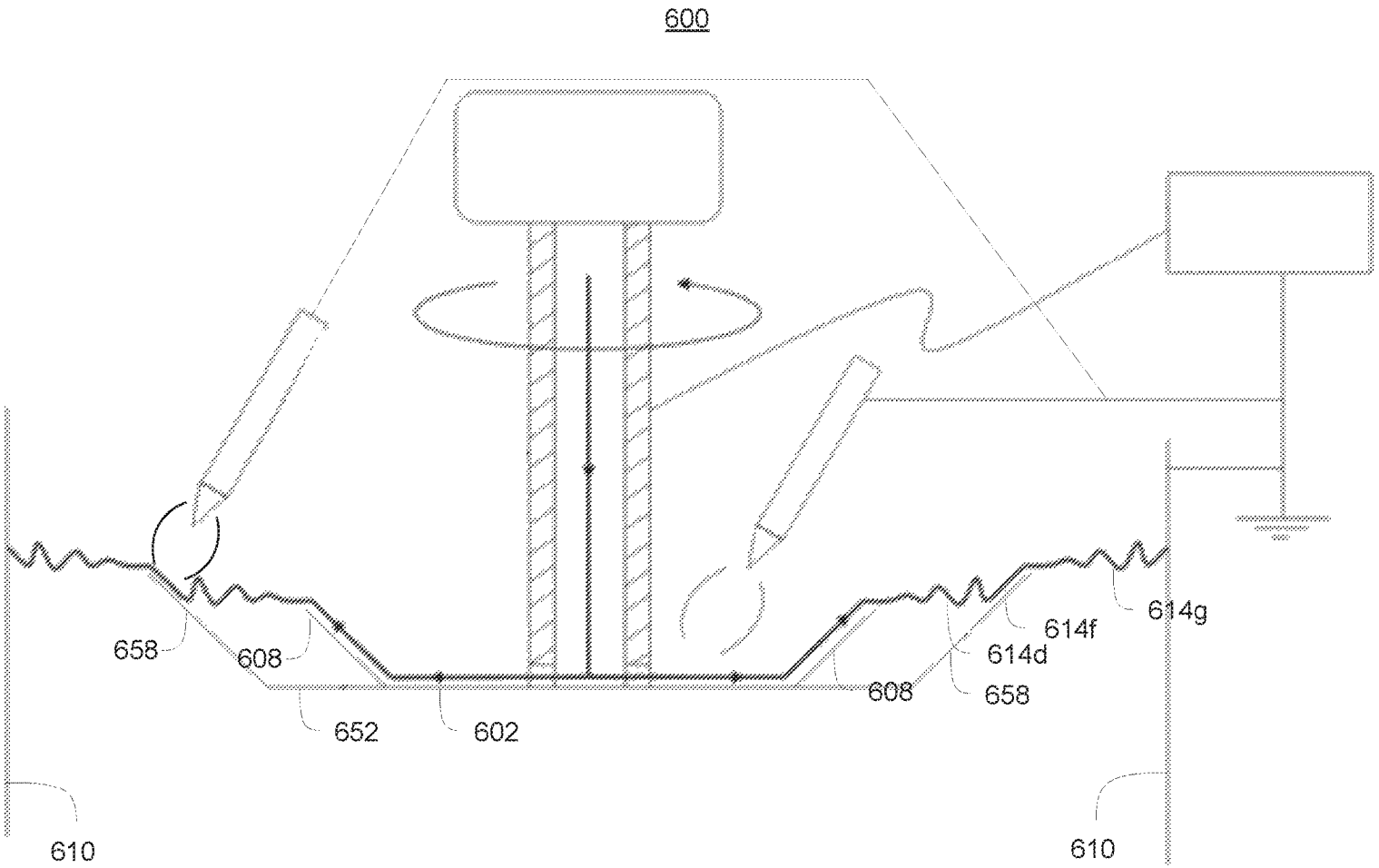
FIG. 6 is an elevation view of an apparatus for mixing and dispersing a dispersed phase in a medium, having two co-planar and co-axial rotating surfaces and two transverse distal surfaces.

Referring to FIG. 6, there is shown an apparatus 600 for mixing and dispersing a dispersed phase in a medium, and, in particular, an interfacial dispersion device using two co-planar and co-axial rotating surfaces and two transverse distal surfaces.

The apparatus 600 comprises a first rotating surface 602 having a transverse distal surface 608, and a second rotating surface 652 having a transverse distal surface 658.

A projectile-receiving location can be defined as a region where projectiles are captured such that they reform a film flow, and/or coalesce onto a collection surface. As shown in FIG. 6, projectiles 614*d* are formed on the edge of the transverse distal surface 608 of the rotating surface 602. Objects undergo intensive dispersion in projectiles during the flight path, and then the projectiles are captured and reform a film flow on the more distal transverse distal surface 658.

Objects undergo further intensive dispersion in the transverse distal surface 658 film flow 614*f*. The film flow 614*f* is subsequently ejected from the edge of the transverse distal surface 658 as projectiles 614*g*, subjecting the objects to further intensive dispersion.

The projectiles are captured and coalesce as a bulk heterogeneous compound on a collection surface 610.

Figure 7:
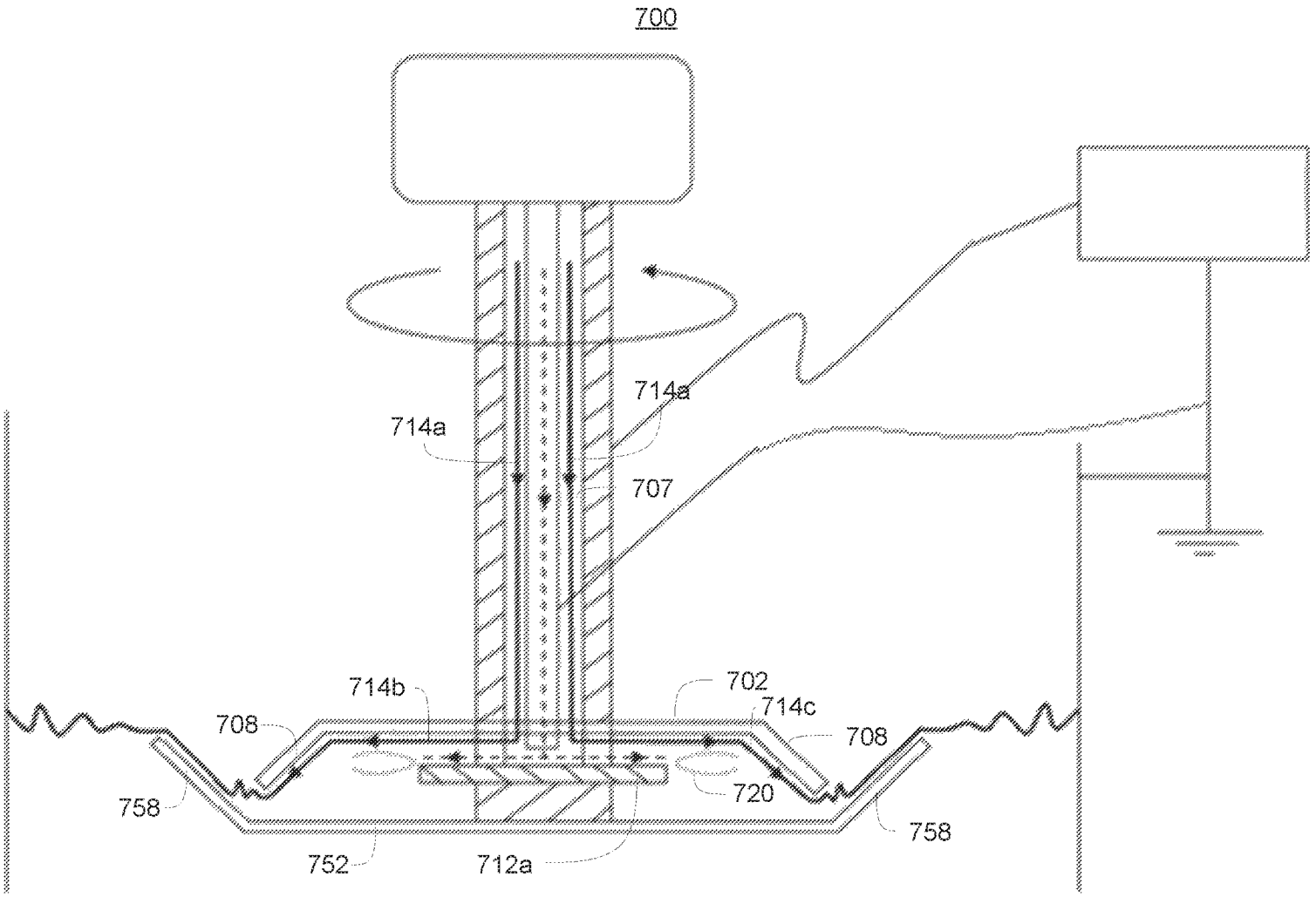
FIG. 7 is an elevation view of an apparatus for mixing and dispersing a dispersed phase in a medium, having two rotating surfaces, where the first rotating surface is inverted over the second rotating surface, according to some embodiments.

Referring to FIG. 7, there is an apparatus 700 for mixing and dispersing a dispersed phase in a medium. In particular, FIG. 7 shows an interfacial dispersion device that uses a first rotating surface that is inverted over a second rotating surface.

FIG. 7 shows a configuration for a closed-flow path. A first rotating surface 702 is inverted over a second rotating surface 752. The first rotating surface 702 has a transverse distal surface 708 that extends down from the rotating surface 702; and the second rotating surface 752 has a transverse distal surface 758 that extends up from the rotating surface 752.

As indicated by the arrows, the medium 714*a* flows from the medium feed conduit 707 and forms a film 714*b* on the bottom face of the rotating surface 702.

The apparatus 700 also includes a rotating atomizing surface 712*a*, located between the rotating surface 702 and the rotating surface 752.

Aerosolized constituents 720 of the dispersed phase are formed from the rotating atomizing surface 712*a*, and are deposited on the bottom face of the rotating surface 702 to form the compound 714*c*.

Figure 8:
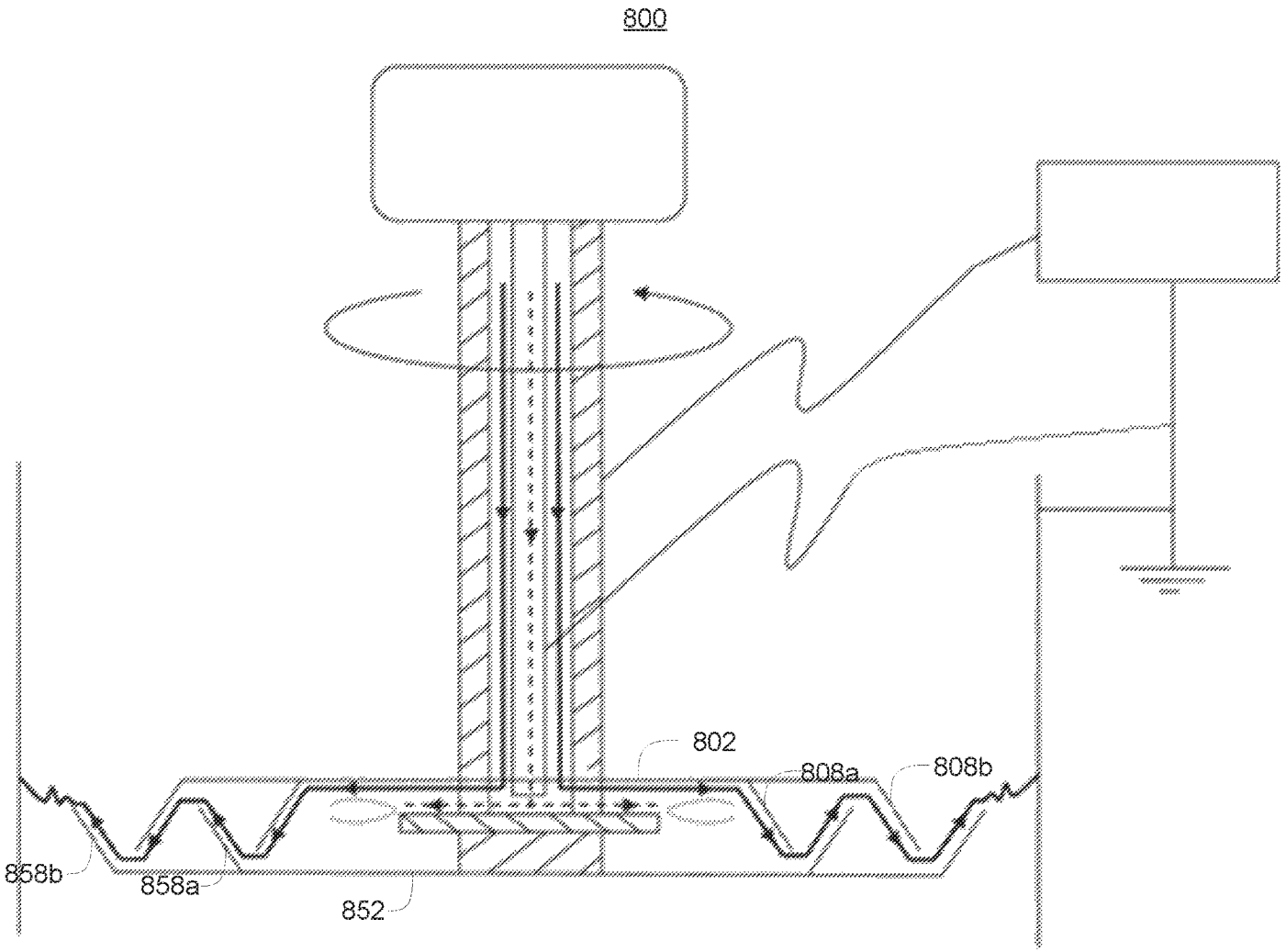
FIG. 8 is an elevation view of an apparatus for mixing and dispersing a dispersed phase in a medium, having two rotating surfaces, where each rotating surface has two transverse distal surfaces, and the first rotating surface is inverted over the second rotating surface, according to some embodiments.

Referring to FIG. 8, there is an apparatus 800 for mixing and dispersing a dispersed phase in a medium. In particular, FIG. 8 shows an interfacial dispersion device that uses a first rotating surface with two transverse distal surfaces inverted over a second rotating surface having two transverse distal surfaces, according to some embodiments.

It should be noted here that, in comparison with the apparatus shown in FIG. 6, two co-planar and co-axial rotating surfaces each having a transverse distal surface (as in FIG. 6) are the same as one rotating surface having two transverse distal surfaces.

FIG. 8 shows a configuration for a closed-flow path with multiple surfaces. A first rotating surface 802 is inverted over a second rotating surface 852. The first rotating surface 802 has two transverse distal surfaces 808*a* and 808*b*. The second rotating surface 852 has two transverse distal surfaces 858*a* and 858*b*.

As shown by the arrows, the flow path in FIG. 8 is from a medium, to a medium film on the bottom face of the rotating surface 802 (where deposition of the aerosolized dispersed phase occurs), to the first transverse distal surface 808*a* of the rotating surface 802, to the first transverse distal surface 858*a* of the rotating surface 852, then back to the rotating surface 802, and then from the transverse distal surface 808*b* of the rotating surface 802 to the transverse distal surface 858*b* of the rotating surface 852.

Figure 9:
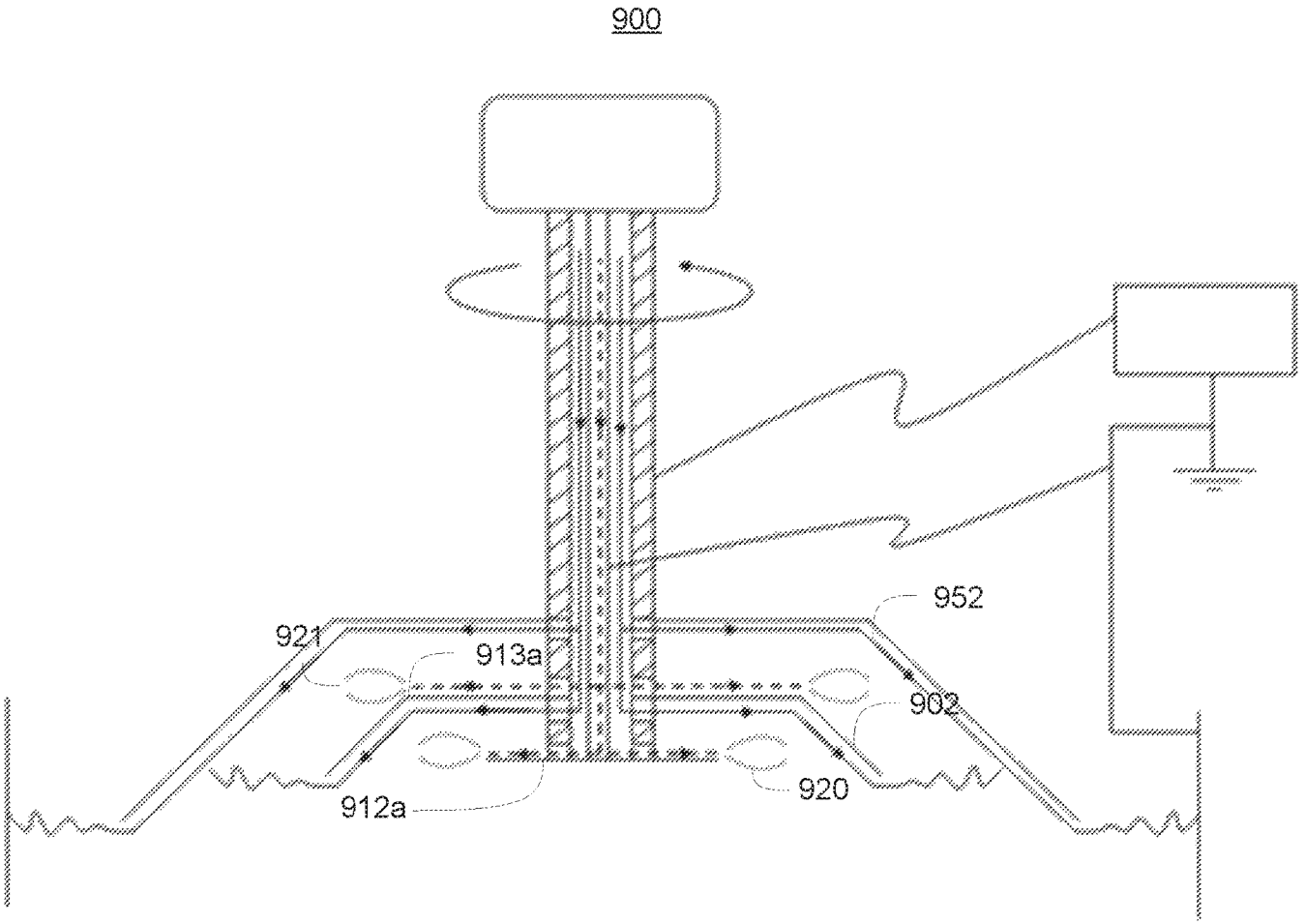
FIG. 9 is an elevation view of an apparatus for mixing and dispersing a dispersed phase in a medium, having two inverted rotating surfaces, according to some embodiments.

Referring to FIG. 9, there is an apparatus 900 for mixing and dispersing a dispersed phase in a medium. In particular, FIG. 9 shows an interfacial dispersion device that uses two inverted rotating surfaces. FIG. 9 shows a configuration for an open-flow path with multiple surfaces.

A first rotating surface 902 is inverted underneath a second inverted rotating surface 952. A rotating atomizing surface 912*a* is located under the rotating surface 902 for producing aerosolized constituents 920.

In order to produce aerosolized constituents 921 for deposition into the film flow on the bottom face of the rotating surface 952, the top face of the rotating surface 902 is used as a rotating atomizing surface 913*a*.

As indicated by the arrows in FIG. 9, the medium is applied to the bottom face of each of the rotating surfaces 902 and 952. Aerosolized constituents 920 are deposited into the medium film on the bottom face of the rotating surface 902, and aerosolized constituents 921 are deposited into the medium film on the bottom face of the rotating surface 952. Projectiles from the transverse distal surface of the rotating surface 902 are collected by the rotating surface 952 for further dispersion.

Figure 10:
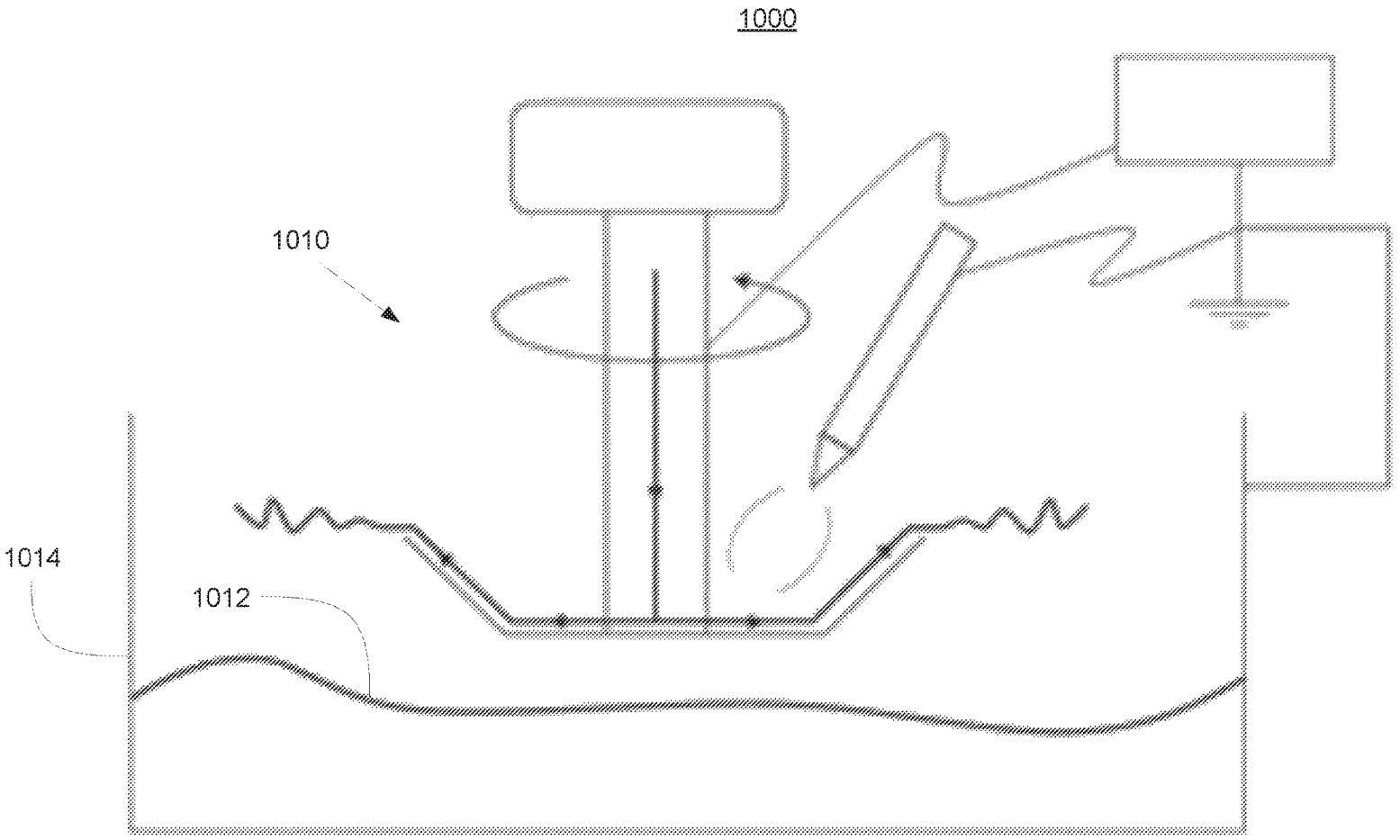
FIG. 10 is an elevation view of an apparatus for mixing and dispersing a dispersed phase in a medium, having a collection reservoir, according to some embodiments.

Referring to FIG. 10, there is an apparatus 1000 for mixing and dispersing a dispersed phase in a medium.

A single interfacial dispersion device 1010 can be used to produce compounds by accumulating the compound material 1012 in a reservoir 1014 in a batch, semi-continuous, or continuous production/collection manner. The embodiment shown in FIG. 10 is indicative of embodiments that pertain to compounds that generate ligament/film and/or droplet/solid aerosol projectiles.

Figure 11:
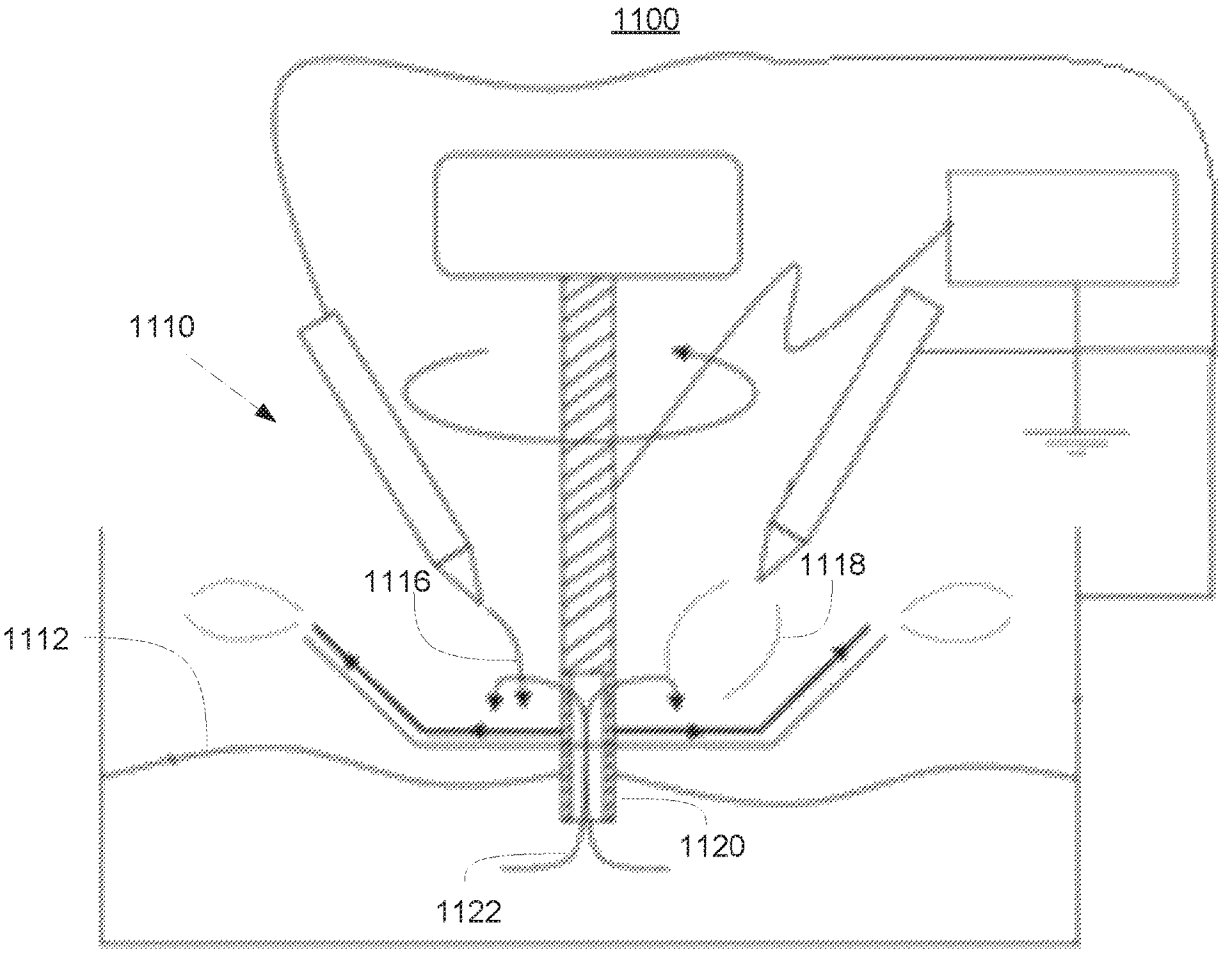
FIG. 11 is an elevation view of an apparatus for mixing and dispersing a dispersed phase in a medium, having a recirculating loop, according to some embodiments.

Referring to FIG. 11, there is an apparatus 1100 for mixing and dispersing a dispersed phase in a medium. The embodiment shown in FIG. 11 is indicative of embodiments that pertain to the generation of droplet projectiles.

The medium 1116 and dispersed-phase aerosolized constituents 1118 are deposited onto the rotating surface of the interfacial dispersion device 1110. A hub 1120 protrudes into the collected material 1112. A low-pressure region is generated near the base of the hub 1120, for instance, by a rotating vane blade, thereby sucking the accumulation material up the hollow portion of the drive shaft.

A recirculating loop 1122 is created, whereby the accumulated material is sucked up and re-deposited on the rotating surface for further dispersion by increasing the dispersion residence time.

The embodiments depicted in FIG. 3 through to FIG. 11 include one or two rotating surfaces in various configurations. These embodiments provide examples of these various configurations. It should be appreciated that other embodiments can be configured to include more than two rotating surfaces in various configurations. There is no particular limit to the number of rotating surfaces that can be used.

Figure 12:
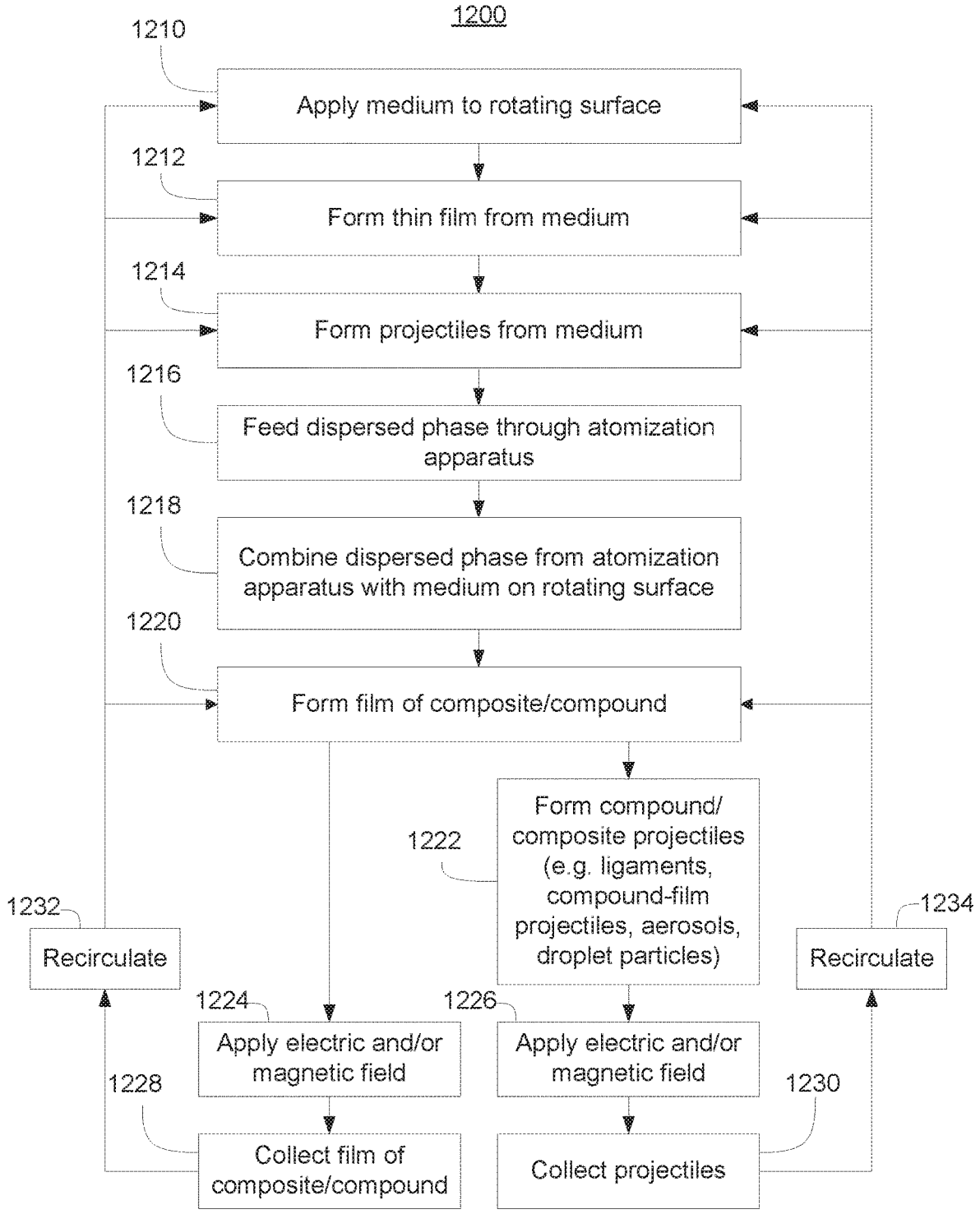
FIG. 12. is a flow diagram depicting a method for mixing and dispersing a dispersed phase in a medium, according to some embodiments.

Referring to FIG. 12, there is shown a method 1200 for mixing and dispersing a dispersed phase in a medium, according to some embodiments.

According to some embodiments, the method 1200 may be performed using the interfacial dispersion technology, apparatus, and systems previously described. According to other embodiments, the method 1200 may be performed by other technology, apparatus, and systems, such as those having a rotating surface for spinning (mixing).

The method 1200, as shown, assumes that the dispersed phase and the medium have already been prepared. The dispersed phase may comprise an external-phase carrier fluid (e.g. liquid, gas, or air), and an internal phase of fillers and/or additives.

At step 1210, the medium is applied to the rotating surface (for example, the rotating surface of an interfacial dispersion apparatus). The rotating surface may be used to make the medium receptive (i.e. generate a "receptive medium") for combining with the dispersed phase. A receptive medium may be generated by forming a thin film of the medium, and/or forming projectiles from the medium or medium thin film.

Whether or not a thin film (alone) is formed from the medium, or a thin film and projectiles are formed, or projectiles are formed from a thin film, may be determined by the composition and type of the medium, the composite/compound to be produced, etc.

According to some embodiments, the steps of forming a thin film and/or forming projectiles may not be necessary. At step 1212, the medium is spun on the rotating surface in order to form a thin film of the medium. At step 1214, projectiles are formed from the medium. The projectiles may be formed at step 1214 either from the thin film formed at step 1212, or directly from the medium from step 1210, or both.

Projectiles are described here as including: ligaments; films; droplet; and solid aerosols. Ligaments and films are generated when the external phase of the medium is a viscoelastic material, such as a polymer. Ligaments are continuous, amorphous filament-shaped structures. When the flow rate (e.g. of the medium) exceeds conditions necessary for ligament formation, two-dimensional sheet-like films are generated. Droplets are spheroid-shaped or spherical-shaped aerosolized objects that are generated when the external phase of the medium exhibits Newtonian-like behavior (e.g. in the case of water or a solvent). Solid aerosols are a colloid of fine solid particles in air or another gas that are generated when the medium includes solid objects and the external phases are either a gas, air, or a liquid that are removed (e.g. evaporated) prior to the instance when the projectiles are formed.

At step 1216, the prepared dispersed phase is fed to an atomizing apparatus. The dispersed phase is aerosolized and, at step 1218, the constituents ("aerosolized constituents") are deposited into the receptive medium. The dispersed phase is aerosolized to cause distribution and dispersion of the objects upon combining with the receptive medium.

According to some embodiments, in addition to, or instead of depositing aerosols into the receptive medium, continuous fibers (e.g. produced via electrospinning) can be deposited into the receptive medium.

The aerosolized constituents consist of a plurality of micro and/or nano objects (e.g. additives and/or fillers) in solid, liquid, and/or gas physical states. Liquid-phase aerosolized constituents (e.g. carrier fluid and/or additives) may be removed (e.g. evaporated) in their entirety, or partially, or they may be deposited into the receptive medium.

The combination of aerosolized constituents deposited into the receptive medium (collectively, the "composite" or the "compound") results in a compound with an external phase that was the external phase of the medium, while the internal phase of the compound (the "compound constituents") comprise a consolidation of the internal phases of the dispersed phase and the internal phases of the medium.

According to some embodiment, and/or the particular composition of the dispersed phase, the external phase of the dispersed phase may partially or entirely evaporate. Evaporation may also occur during the thin-film stage.

At 1220, a film is formed from the compound (or composite). The film of the compound is formed by way of shear and extensional flow deformation induced by forces (e.g. centrifugal force) and physical properties of the compound (e.g. surface tension, viscosity). Formation of the thin film and dispersion of the compound constituents therein may be performed at room temperature, an elevated temperature, or any other temperature.

According to some embodiments, projectiles may also be formed from the compound (or composite) at step 1222. The formation of projectiles from the compound is generally similar to the formation of projectiles previously described for the projectiles formed from the medium.

Projectiles are generated by ejecting the compound from the region where the film flow develops, which is deemed an "ejection location". The projectiles subsequently traverse a region (the "flight path" or "projectile path") from the ejection location to a receiving location. The receiving location can be defined as a region where projectiles are either deposited and reform a film flow region similar to the ejection location, or are captured by a collection surface to form a bulk, dispersed heterogeneous compound.

At step 1224 (in the case when projectiles are not formed from the composite/compound), or at step 1226 (in the case when projectiles are formed from the composite/compound), an electric field and/or magnetic field may be generated across the projectile path ("flight path"), for example, from the ejection location to the receiving location. The projectiles and surrounding region in which the projectiles travel can be at room or elevated temperature, or any other temperature. An elevated temperature can be supplied by quiescent or convective sources, by inductive heating methods, or any other heating methods.

The region surrounding the projectiles during their flight path can be air or any other gas (e.g. Nitrogen, Argon, $CO_2$), vapor of any other substance (e.g. steam, solvent vapor, chemical vapor), and/or aerosolized environment.

Liquid-phase constituents (e.g. liquid carrier fluids, solvents, and processing aids) that still remain at the instance of projectile formation may or may not be removed (e.g. evaporated) partially or in their entirety during the projectile flight path.

At steps 1228 and 1230, the film and/or projectiles of the compound are collected, for example, on a collection surface, to form a bulk, dispersed heterogeneous compound.

According to some embodiments, steps 1232 and 1234 may be employed in order to recirculate the collected projectiles and film back into the dispersion process. For example, according to some embodiments, the collected projectiles and/or film may be introduced or substituted in place of the medium, which could take place: a) on the rotating surface (e.g. step 1210); b) within the medium thin film (e.g. step 1212); c) within the medium projectiles (e.g. step 1214); or d) within the compound film (e.g. step 2020) in order to provide for additional distribution and dispersion, as well as external-phase evaporation.

Figure 13:
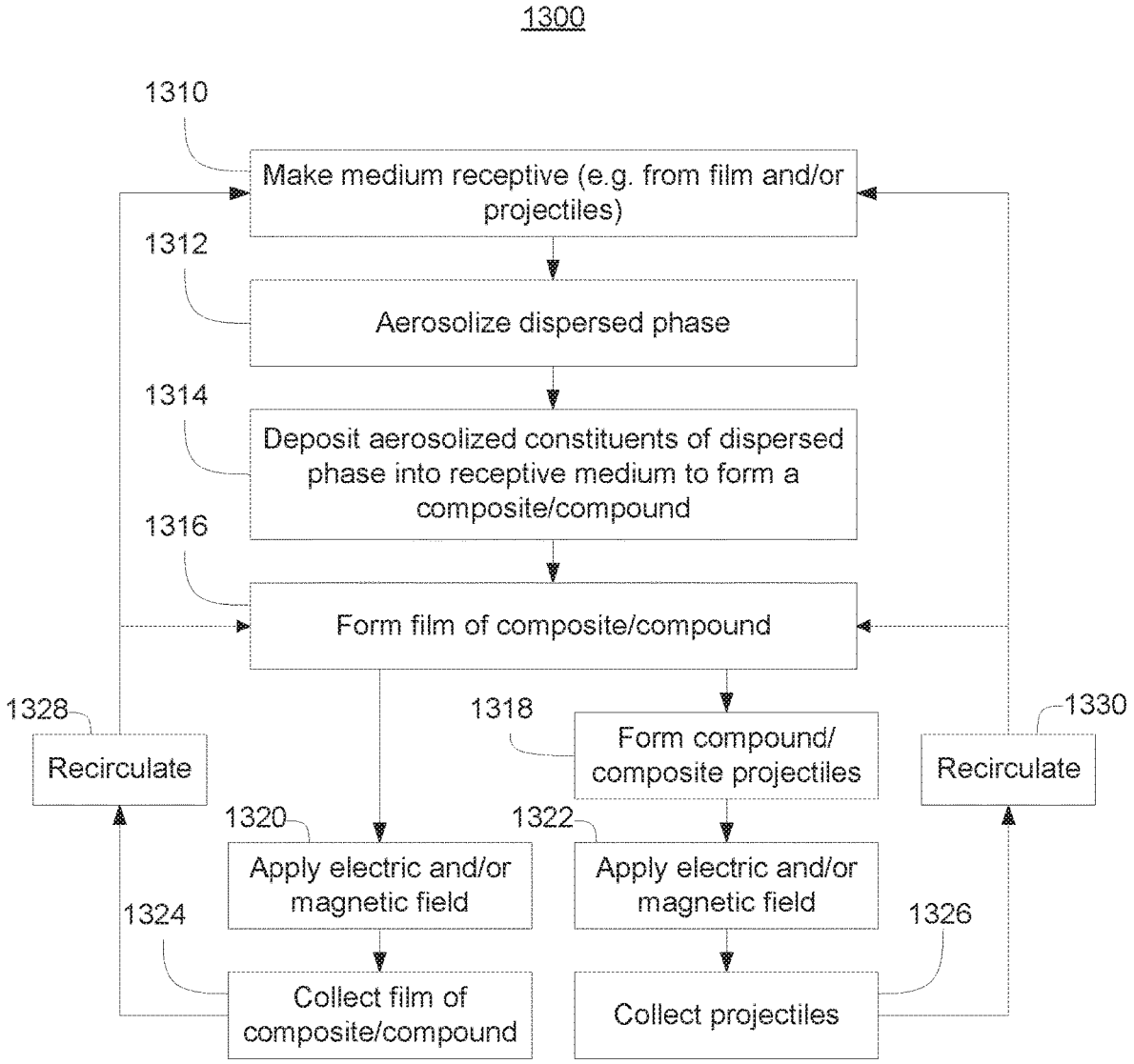
FIG. 13 is a flow diagram depicting a method for mixing and dispersing a dispersed phase in a medium, according to some embodiments.

Referring to FIG. 13, there is shown a method 1300 for mixing and dispersing a dispersed phase in a medium, according to some embodiments. The method 1300, as shown, assumes that the dispersed phase and the medium have already been prepared.

At step 1310, the medium is made receptive, such as by forming a thin film and/or projectiles.

At step 1312, the dispersed phase is aerosolized or atomized in order to promote object dispersion and distribution upon combination with the receptive medium. For example, aerosolization or atomization may be accomplished with an aerosol or atomizing apparatus such as a spray jet (e.g. nozzle), or a rotating surface. According to some embodiments, the step of aerosolizing the dispersed phase may comprise applying aerosolized dispersed phase from a spray jet onto a rotating atomizing surface.

At step 1314, the aerosolized constituents of the dispersed phase are deposited into the receptive medium in order to form a composite or compound.

At step 1316, a film (e.g. thin film) of the compound is generated. For example, this may be accomplished by applying the compound to a rotating surface, or otherwise inducing shear and/or extensional flow deformation.

At step 1318, projectiles may be formed from the compound, such as has been generally described above.

According to some embodiments, an electric field, magnetic field, and/or an electromagnetic field may be applied across the compound. For example, at step 1320, a field may be applied across a film of the compound, and at step 1322, a field may be applied across the projectile path of the compound projectiles. For example, any combination of positive and negative voltages can be applied across the rotating surfaces and the atomizing devices, such as to control the trajectories of the projectiles as well as the dispersion and distribution of the aerosolized constituents.

At steps 1324 and 1326, the compound film and/or projectiles are collected, and a bulk, dispersed heterogeneous compound may be obtained.

According to some embodiments, steps 1328 and 1330 may be employed in order to recirculate the collected projectiles and film back into the dispersion process, such as by introduction to the medium or receptive medium at step 1310 or the film of the composite or compound at step 1316.

The apparatus and methods described above can be used for the dispersion of compound constituents in various types of projectiles. A few cases are provided here, by way of example.

In the case of the dispersion of compound constituents in liquid ligament or film projectiles, the compound constituents are strongly dispersed while undergoing shear and extensional flow deformation during the flight path by subjecting the ligaments or films to all or a subset of the following forces and mechanisms.

Shear and extensional flow deformation occurs during the attenuation of ligaments by centrifugal force, pressure, and/or aerodynamic forces. The electric field and/or the magnetic field may be used to induce further extensional and shear flow deformation during ligament attenuation and film thinning via electro-hydrodynamic forces (e.g. electrostatic, electrophoretic, and/or dielectrophoretic) and/or magneto-hydrodynamic forces.

The ligaments or films are then subjected to further deformation via a bending instability that is mainly caused by Coulomb forces with charging of the ligament or film, and/or mechanical forces arising from aerodynamic instability of the ligament and film. This can result in very thin ligaments or films having sub-micron dimensions.

During the flight path, the dispersion can be very significant due to strong extensional and shear flow deformation acting on ligaments or films as they whip, since the velocity can be several times the speed of sound.

Additionally, since the ligament diameter or film thickness is in the nanoscale, charging of objects (e.g. fillers and/or additives) with the same polarity within the ligament or film can result in strong repulsion of the charged objects, which further enhances dispersion.

In the case of the dispersion of compound constituents in aerosol or droplet projectiles (where the compound material is inductive of forming droplets or aerosols), as the compound film approaches the ejection location, the film jets out due to centrifugal force.

Instabilities cause the jets to break down into droplets and/or aerosols. Electro-hydrodynamic, magneto-hydrodynamic, and mechanical forces (e.g. centrifugal or aerodynamic), and physical properties (e.g. surface tension) may cause varicose instability (direct droplet/aerosol emission from the jet), and/or kink-type instability (which is large droplet emissions that subsequently emit jets that resolve into finer droplets). For droplet emissions by varicose and kink-type instabilities, electro-hydrodynamic forces may cause successive sub-jet and satellite droplet emissions.

In the case of the dispersion of compound constituents in solid aerosol projectiles, as the compound mixture approaches the ejection location, the solid aerosols eject from the rotating surface due to the centrifugal force. Electro-hydrodynamic, magneto-hydrodynamic, and mechanical forces subsequently govern the projectile path (aerosol flight path), which are eventually collected on a collection surface. In this case, solid aerosols from different materials are subjected to distributive mixing rather than dispersive mixing.

The apparatus and methods described above can be used for the dispersion of various prepared dispersed phases within various prepared media in order to produce various final compounds or composites. This is illustrated by way of some examples.

For example, a dispersed phase can be prepared by using a solvent (external phase) and fillers (internal phase). A medium can be prepared using a liquid polymer (external phase) and no internal phase. These preparations can result in a polymer-filled composite, such as a silicone composite.

For example, a dispersed phase can be prepared by using air (external phase) and fillers (internal phase). A medium can be prepared using a solvent (external phase) with no internal phase. These preparations can result in a solvent colloid, such as a graphene-water colloid.

For example, a dispersed phase can be prepared by using air (external phase) and fillers (internal phase). A medium can be prepared using a solvent (external phase) and fillers (internal phase). These preparations can result in a filler-filler composite, such as a post-process ceramic composite or an alloy.

For example, a dispersed phase can be prepared by using a solvent (external phase) and a polymer (internal phase). A medium can be prepared using a polymer (external phase) and no internal phase. These preparations can result in a polymer-polymer composite.

As described with reference to FIG. 10, it is possible to couple interfacial dispersion devices with a single collection reservoir. However, in some cases this approach might not be scalable so as to meet mass-production needs.

Instead of coupling an individual collection reservoir with each interfacial dispersion device, it is possible to arrange clusters or arrays of interfacial dispersion devices that share a single consolidated material accumulation and collection. Some examples and embodiments are provided in FIGS. 14-17. The physical state of the compounds in these figures and embodiments are shown for illustrative purposes, but are otherwise interchangeable.

Figure 14:
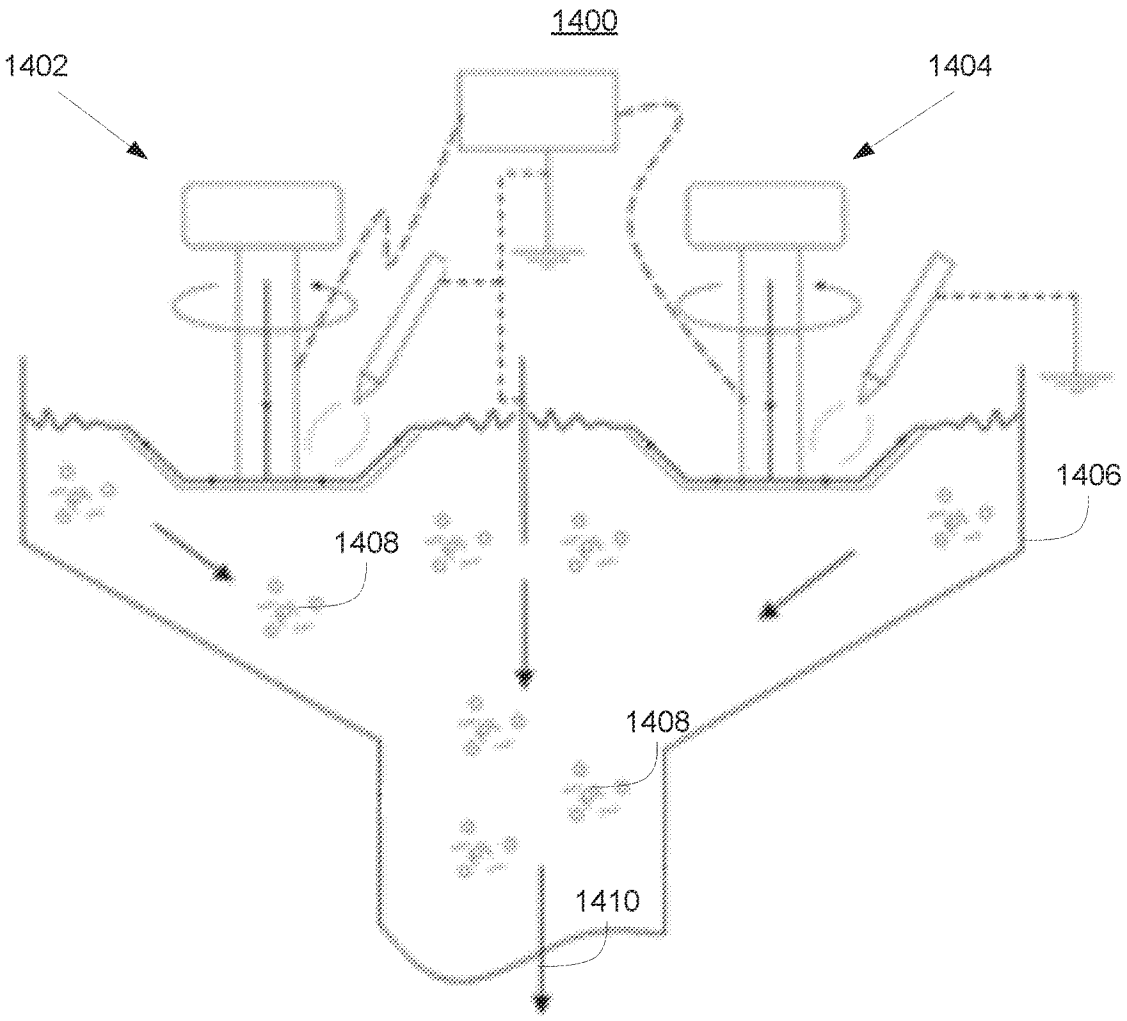
FIG. 14 is an elevation view of a system for producing a compound with a plurality of interfacial dispersion devices, according to some embodiments.

Referring to FIG. 14, there is a system for 1400 producing a compound with a plurality of interfacial dispersion devices. The embodiment shown in FIG. 14 is indicative of embodiments that pertain to compounds that generate projectiles (ligaments/films and/or droplets/solid aerosols) with a solid physical state.

Interfacial dispersion devices 1402 and 1404 are clustered in a duct shroud 1406. The flow path from multiple duct shrouds 1406 may be linked into a duct network.

The interfacial dispersion devices 1402 and 1404 generate solid-state projectiles 1408 that are fluidized by airflow 1410 through the duct, or by way of gravity.

Figure 15:
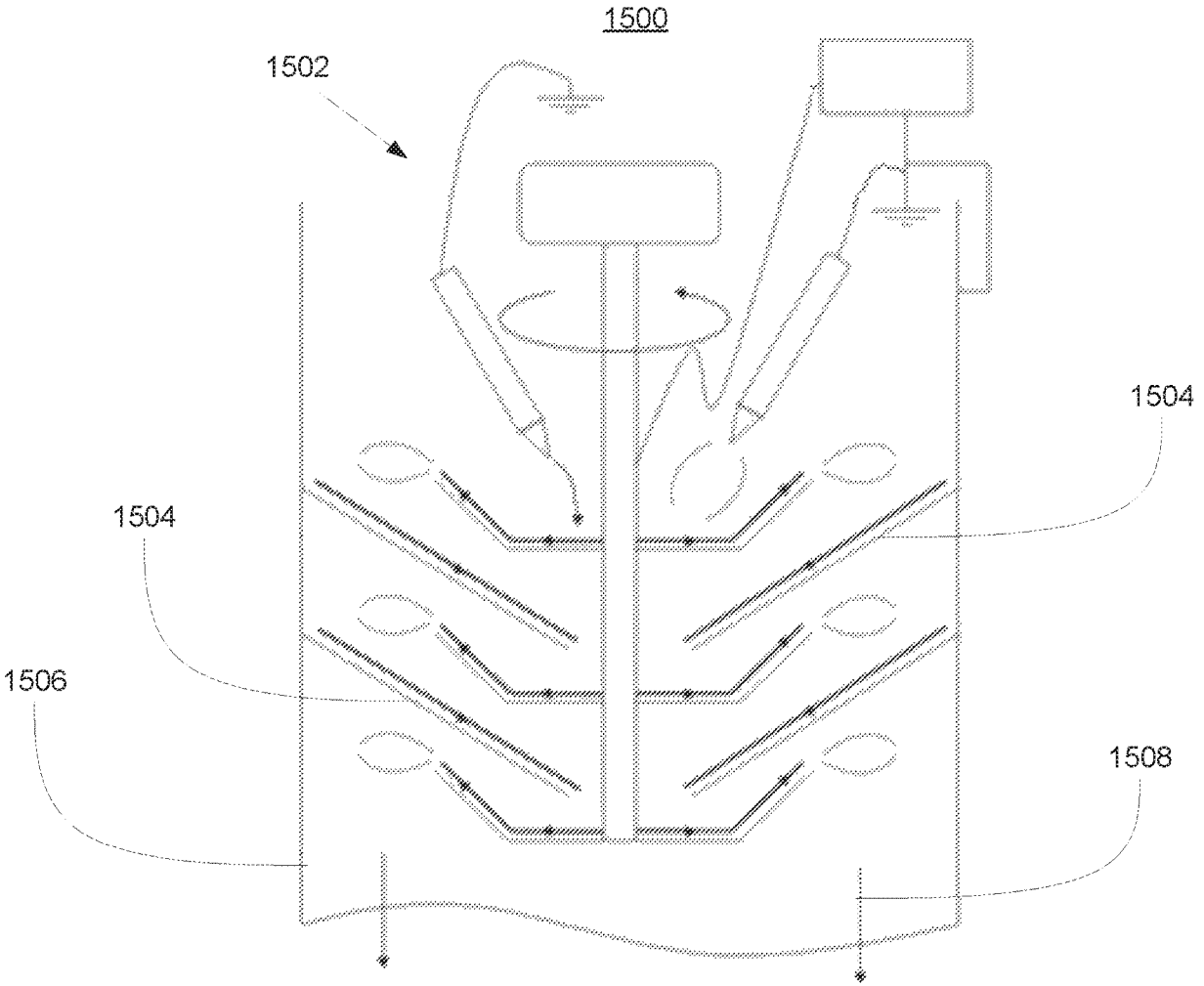
FIG. 15 is an elevation view of a system for producing a compound with a plurality of rotating surfaces in a cascading flow path, according to some embodiments.

Referring to FIG. 15, there is a system 1500 for producing a compound with a plurality of interfacial dispersion devices. The embodiment shown in FIG. 15 is indicative of embodiments that pertain to collected compounds that exhibit highly-flowable (e.g. Newtonian-fluid) behavior.

In the configuration shown in FIG. 15, a series of interfacial dispersion devices 1502 are separated vertically and coupled to a single drive shaft. The medium and dispersed phase are deposited on the upper-most interfacial dispersion device, which thereby disperses objects therein, and ejects projectiles that are captured by non-rotating angled baffles 1504 connected to the perimeter of a duct 1506.

The accumulated compound is cascaded down to the next interfacial dispersion device where the material is subsequently dispersed, captured by the next baffle 1504, and cascaded further down the duct. The process can be repeated any number of times, for any number of baffles and interfacial dispersion devices.

A gaseous (e.g. air) flow 1508 through the duct 1506 may be used to assist with fluidizing the accumulated compound or enhance the removal (e.g. evaporation) of constituents in liquid physical states. The gas flow may be in a co-flow arrangement (as shown by flow 1508), or in a counter-flow (reverse flow) arrangement.

Figure 16:
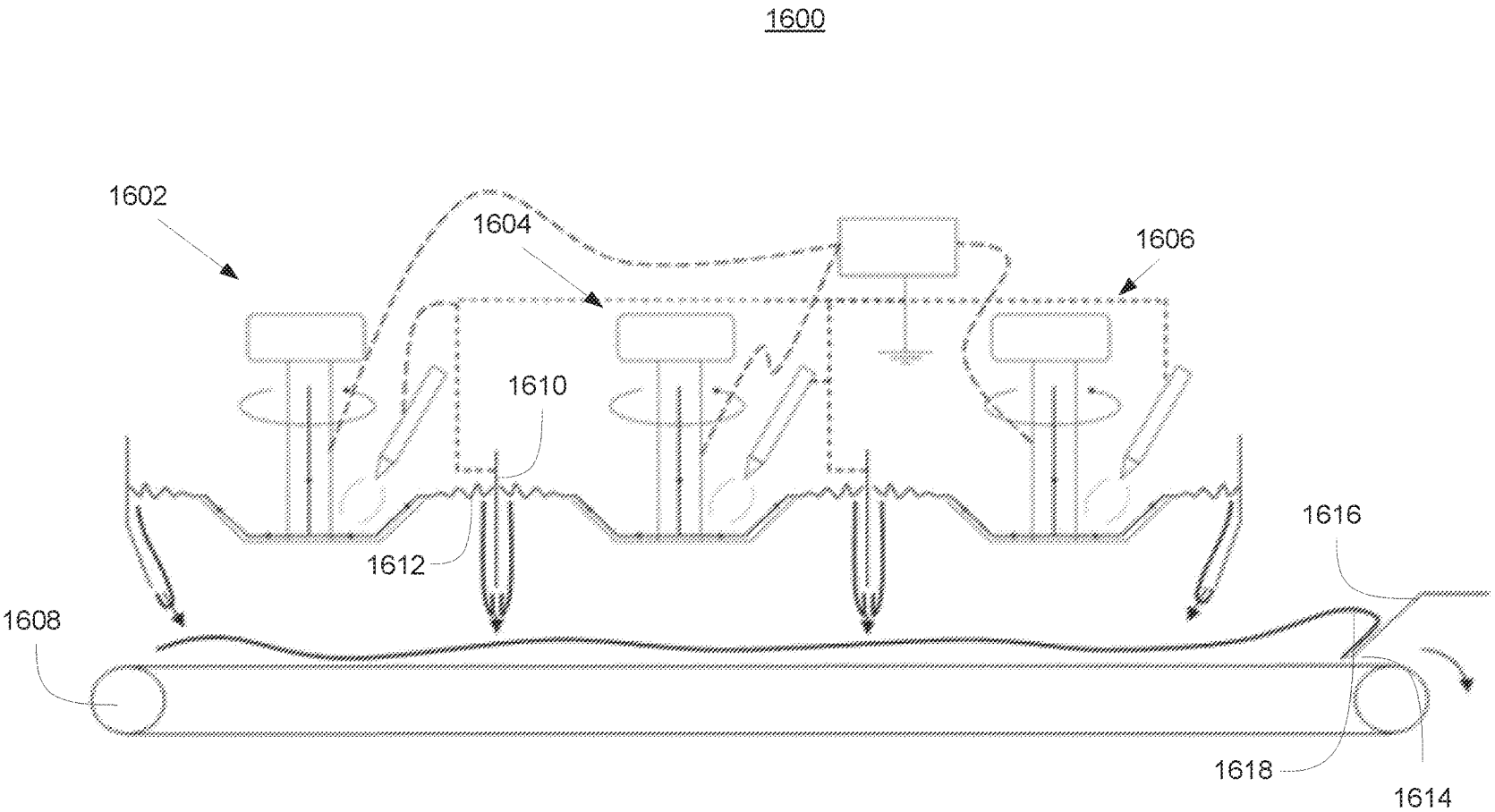
FIG. 16 is an elevation view of a system for producing a compound with a plurality of interfacial dispersion devices and a conveyor, according to some embodiments.

Referring to FIG. 16, there is a system 1600 for producing a compound with a plurality of interfacial dispersion devices. The embodiment shown in FIG. 16 is indicative of embodiments that pertain to collected compounds that exhibit highly-viscous or viscoelastic behavior (e.g. non-Newtonian fluids).

As shown in FIG. 16, interfacial dispersion devices 1602, 1604, and 1606 may be arranged the lengthwise and/or spanwise directions above a conveyor 1608. Each interfacial dispersion device 1602, 1604, and 1606 may be surrounded by a shroud 1610 to capture radially-ejected projectiles 1612.

The accumulated material flows down or is deflected down the surface of the shroud 1610 and is deposited on the conveyor 1608. The conveyed material may cascade off the terminating end 1614 of the conveyor for further processing.

Additionally, a knife-edge collector 1616 may be used to accumulate material at the terminating end 1614 of the conveyor. A device may be positioned transverse to the direction of the belt motion to push the accumulated material 1618 off the conveyor for further processing.

Figure 17:
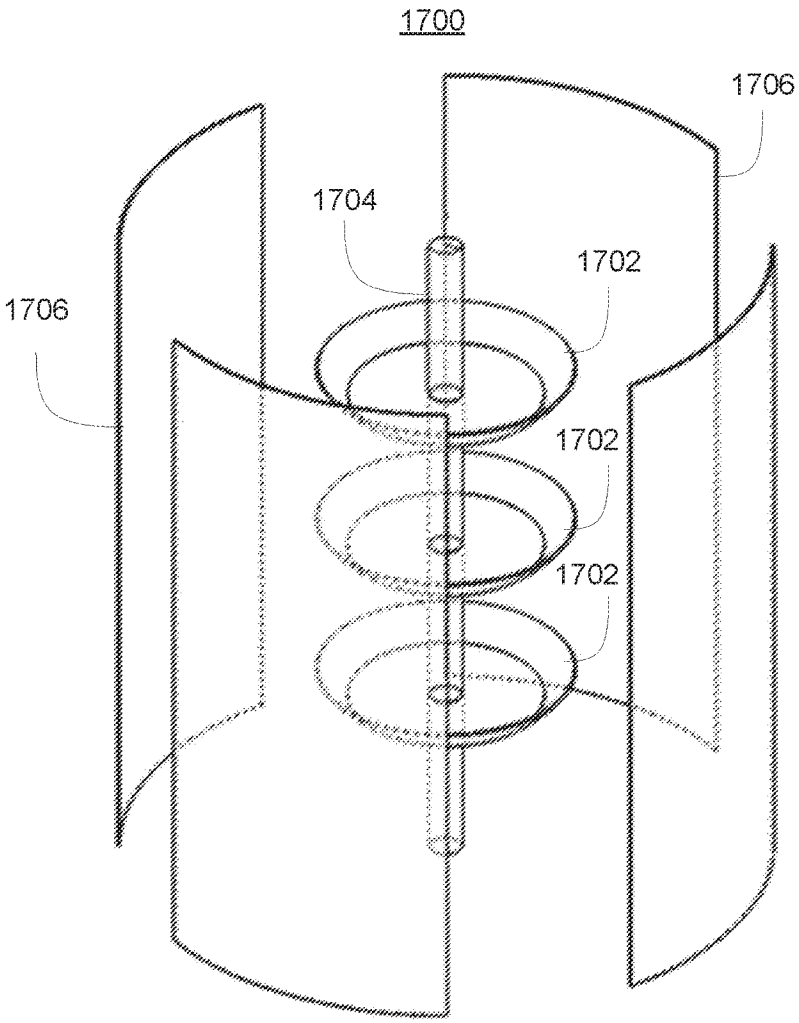
FIG. 17 is a profile view of a system for producing a compound with a plurality of interfacial dispersion devices according to some embodiments.

Referring to FIG. 17, there is a system 1700 for producing a compound with a plurality of interfacial dispersion devices 1702. According to some embodiments, a series of interfacial dispersion devices 1702 are separated vertically and coupled to a single drive shaft 1704. A medium and a dispersed phase may be deposited onto one or more of the interfacial dispersion devices 1702 simultaneously. For example, the medium may be fed through a conduit in the drive shaft and delivered to the rotating surface of each interfacial dispersion device 1702, and the dispersed phase can be aerosolized into the receptive medium on each disk.

Each of the interfacial dispersion devices 1702 disperses objects (e.g. on a rotating surface), and ejects projectiles that are captured by cylindrical baffles 1706.

According to some embodiments, the cylindrical baffles 1706 may be rotating. For example, the cylindrical baffles 1706 may be coupled to the drive shaft 1704, and may be co-rotating with the surfaces of the interfacial dispersion devices 1702.

Captured projectiles reform in a film flow on the surface of the cylindrical baffles 1706, and projectiles may be further re-ejected at the end of the baffles 1706.

During this process, objects may undergo intensive dispersion, and production rates may be increased, according to some embodiments.

Figure 18:
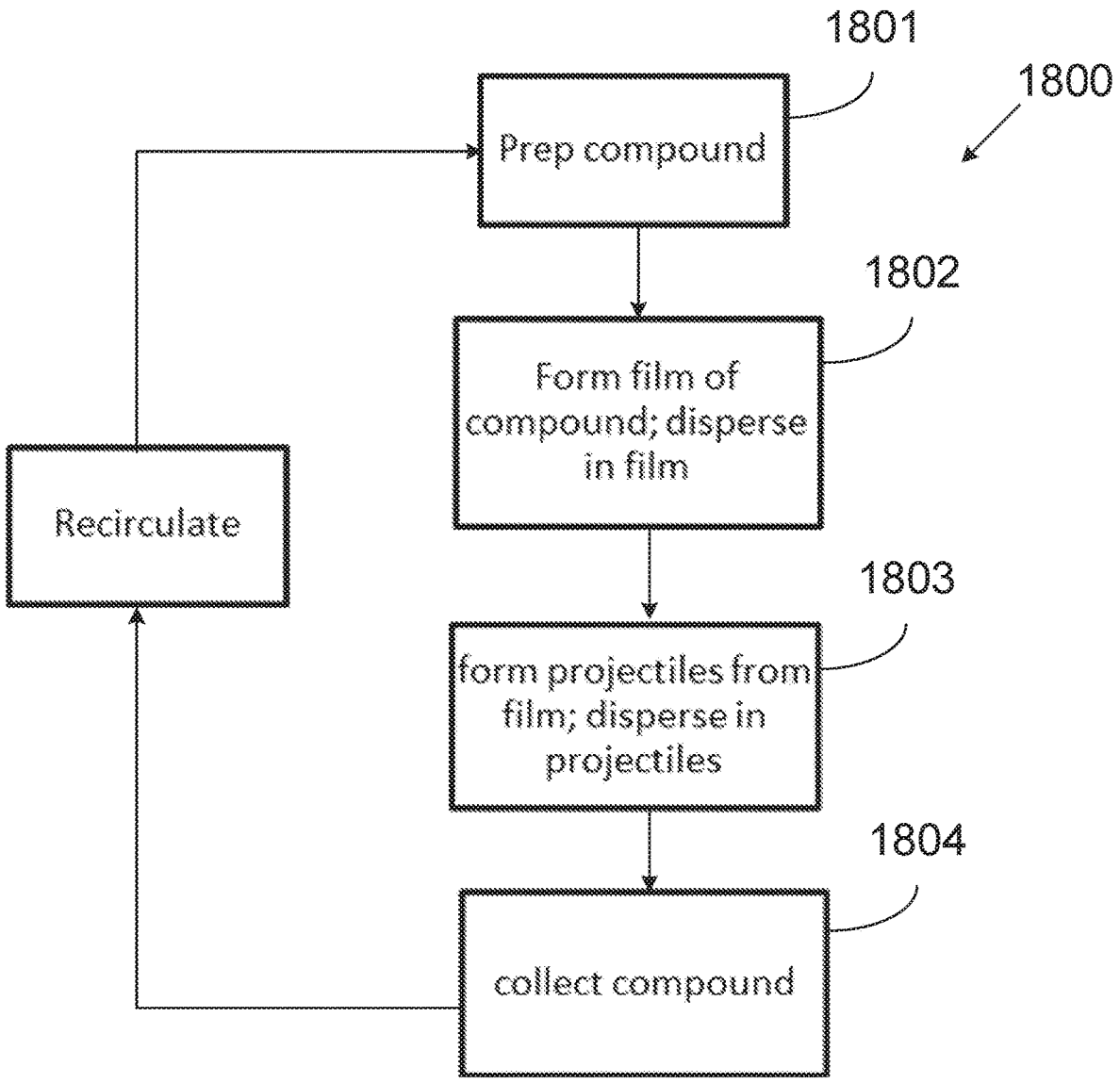
FIG. 18 is a flow diagram depicting a method for mixing and dispersing a dispersed phase in a medium, according to some embodiments.

Referring to FIG. 18, there is shown a method 1800 for mixing and dispersing a compound without a dispersed phase, according to some embodiments. In these embodiments, the compound can be more generally described by an internal phase and an external phase, without the dispersed phase and medium constituent phases as were previously described. In these embodiments, the internal phase may contain objects.

At a first step 1801, the compound is prepared. Preparing the compound can include combining an internal phase of the compound and an external phase of the compound such as by, for example, mixing. In some embodiments, preparing the compound may include mixing using, for example, a mechanical mixer with a mixing element (such as but not limited to a helical mixing element).

At a second step 1802, a film of the compound is formed and dispersion occurs within the film. In this step, the compound (including the internal phase and the external phase mixed together) is deposited onto a rotating surface (such as but not limited to the rotating surface described with reference to FIG. 19, below). In some embodiments, the rotating surface is a circular surface and the compound is deposited at the center of the rotating surface.

As the rotating surface rotates, centrifugal force causes the compound to form a film on the rotating surface. Dispersion may then occur within the film via shear and extensional deformation during rotation of the rotating surface. In some examples, dispersion of the internal phase and the external phase within the thin film can be via extensional and shear deformation. Ejected ligaments and further attenuating ligaments promote dispersion of objects via extensional and shear deformation.

At a third step 1803, projectiles are formed from the film and dispersion occurs in the projectiles. According to some embodiments, projectile formation may include generating liquid ligaments at an edge of a rotating disk. According to some embodiments, projectile formation may further include transferring, distributing, and/or dispersing the dispersant into the compound.

According to some embodiments, the liquid ligaments can be further deformed by attenuation/drawing. This can further promote the efficient transformation, distribution, and/or dispersion of the dispersant into the compound.

According to some embodiments, at step 1803, it is possible to re-introduce the preliminary form at step 1802 in order to further enhance dispersion in the thin film and/or projectiles at step 1802 and 1803, respectively.

At step 1804, the composite or compound 100 is collected. For example, this collection might include collecting liquid projectiles as a liquid composite or compound on a collection surface and/or collecting a liquid film of the liquid composite or compound.

According to some embodiments, dispersion may be further enhanced by recirculating the compound after it is collected. For example, the compound collected at step 1804 may be re-introduced with the compound prepared at step 1801 during the step 1802. According to some embodiments, more than one recirculation can be performed to enhance dispersion. For instance, two or more recirculations may be performed, or five or more recirculations may be performed, or ten or more recirculations may be performed.

Figure 19A:
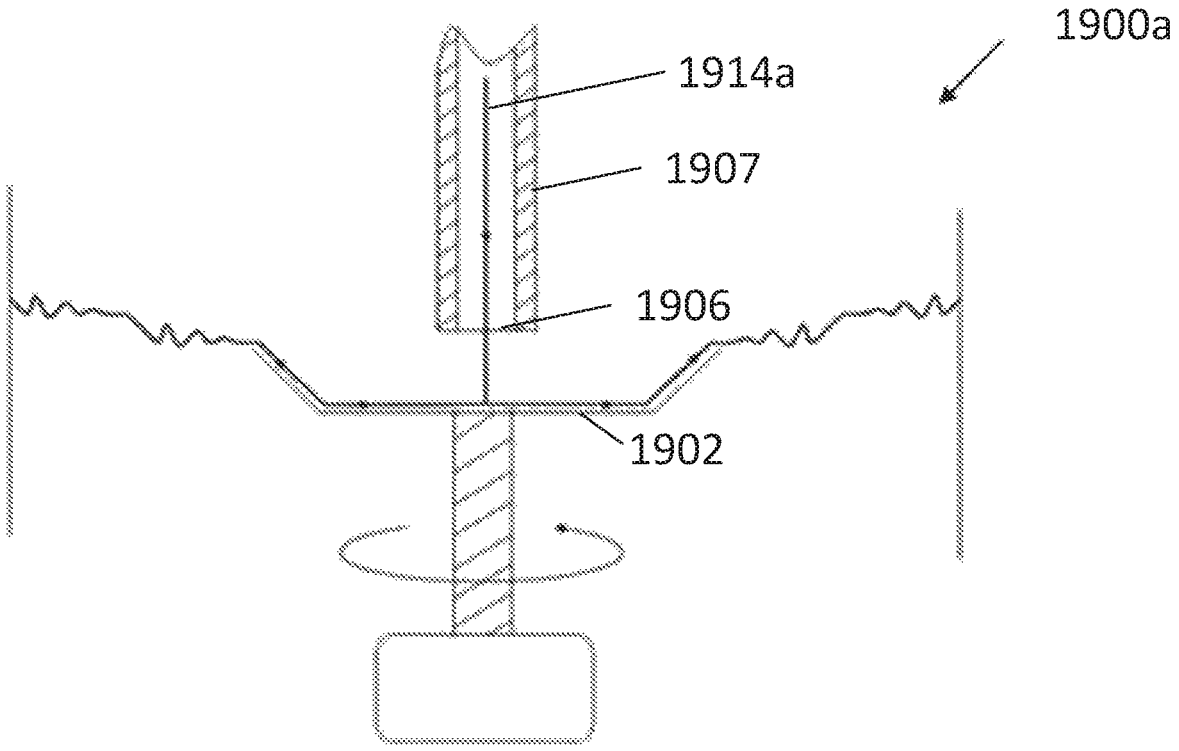
FIG. 19A is an elevation view of an apparatus for mixing and dispersing a dispersed phase in a medium, according to some embodiments.
Figure 19B:
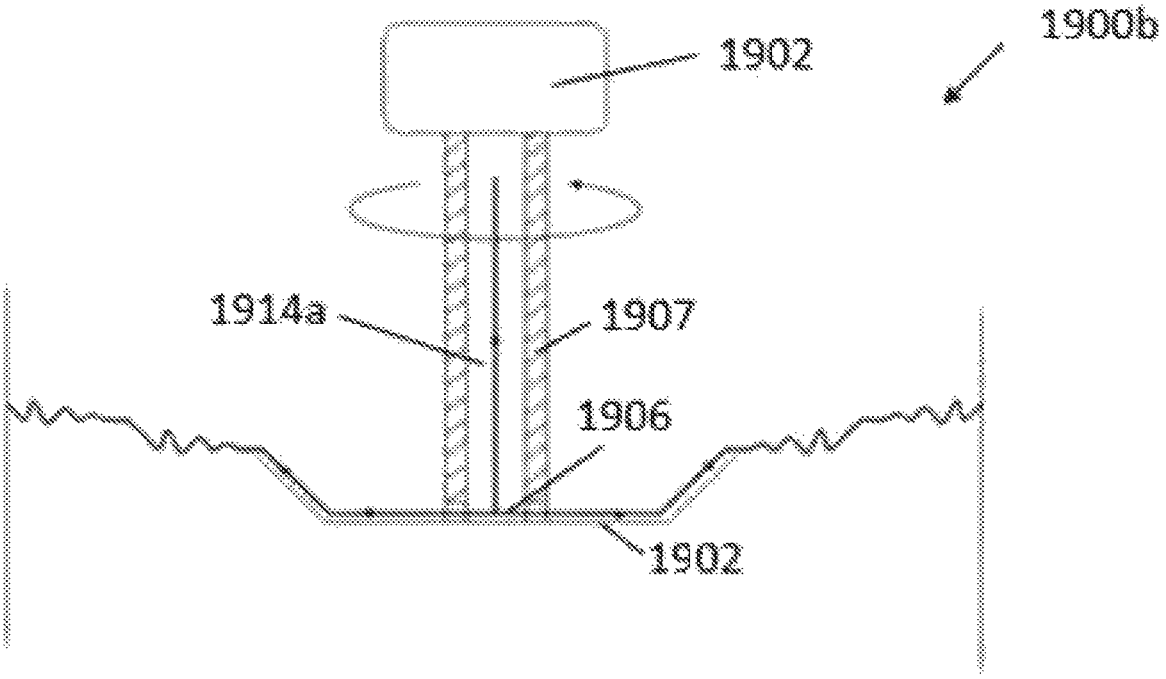
FIG. 19B is an elevation view of another apparatus for mixing and dispersing a dispersed phase in a medium, according to some embodiments.

Referring now to FIGS. 19A and 19B, shown therein are apparatuses 1900*a* and 1900*b*, respectively, for mixing and dispersing a compound without a dispersed phase, according to two embodiments.

Certain elements of the apparatuses 1900*a* and 1900*b* that are similar to those in apparatuses described above are referred to using like reference numerals, incremented by a multiple of 100. To avoid repetition, the similar elements are not discussed in as much detail. Unless otherwise stated below, all of the teachings disclosed herein with relation to the apparatuses described above can apply to the apparatuses 1900*a* and 1900*b* as well.

In one embodiment, apparatus 1900*a* includes a feed chamber (such as a piston pump; not shown) that supplies the compound 1914*a* through a conduit (e.g. hose) 1907 with a discharge end 1906 located over a center of a rotating surface 1902. The conduit (e.g. hose) 1907 may also connect to a hollow end of the drive shaft (see 1900*b*), and an air pressurized chamber could be used as a substitute for the feed chamber. Alternatively, another delivery method known in the art may be used.

In one specific embodiment, an electric induction motor 1906 (e.g. 0-24,000 rpm) may be used with apparatuses 1900*a* and 1900*b*. Further, in some embodiments, the collector 1910 may be a 15.5-inch diameter collector and the rotating surface 1902 may be a cone having a 6-inch diameter.

In some embodiments, rotating surface 1902 is a singular rotating surface.

In some embodiments, the mode of forces for projectile formation and attenuation involves no electric forces and, therefore, mechanical forces only (e.g. centrifugal, aerodynamic, etc.).

EXAMPLES

1. Epoxy-Carbon Nanotube (CNT) Compound Constituent Definitions

In one example, an internal-phase may be a filler (e.g. carbon nanotubes) having a concentration in a range of about 0.2 wt % to about 1 wt. % (i.e. about 0.2 to about 1 parts) and an external-phase may be a liquid polymer (i.e. epoxy) having a concentration of about 99.0 wt % to about 99.8 wt. % (i.e. 99-99.8 parts).

In some embodiments, the internal-phase may be a filler (e.g. carbon nanotubes) having a concentration in a range of about 0.01 wt % to about 1 wt. % (i.e. about 0.01 to about 1 parts).

In some embodiments, the liquid polymer is an epoxy-based polymer. For instance, in some embodiments, the liquid polymer is a bisphenol-A epoxy (Epon 828) having a viscosity in a range of about 11,000 cP to about 15,000 cP.

In some embodiments, the compound may include a curing agent. For instance the compound may include a curing agent such as but not limited to EPIKURE 3370 (cycloaliphatic).

The concentration of the internal and external phases may be constant throughout processing, or the concentrations of the internal and external phases could be changed during processing. For instance, the compound could initially be prepared with 0.5 wt. %, of the internal phase (e.g. carbon nanotubes) and after one or more recirculation cycles, the concentration of the internal phase may be increased or decreased by adding the internal phase (e.g. carbon nanotubes) or diluting the compound by adding more external phase material, liquid polymer (e.g. epoxy), respectively.

When the compound is prepared in accordance with a processing procedure according to one or more embodiments described herein, the sheet resistance data of the finished material reported in the Examples below may not depend on a specific internal-phase (e.g. nanotube) concentration in the compound during processing. For instance, the sheet resistance of the finished material at 0.01 wt. % is approx. $1.6\times10^7$ ohm/sq, irrespective of whether the compound was processed at 0.2 or 1 wt. %

Procedure

Step 1: Prepare the Compound

In this exemplary procedure, the first step is to pre-mix the internal-phase into the external-phase for a duration of approximately 30 minutes. Mixing occurred in a mechanical mixer with a helical mixing element at a speed of 500 rpm.

Step 2: Form Film of Compound; Disperse in Compound

The second step is to form the film of the compound by adding the prepared compound to a rotating surface at a flow rate of about 1 kg/min while the rotating surface is rotating at about 15,000 rpm. It can be noted that in these examples, dispersion in the thin film can be via extensional and shear deformation. Ejected ligaments and further attenuating ligaments promote dispersion of objects via extensional and shear deformation.

In some embodiments, the compound is cast onto a flat surface as a coating having a thickness of about 8 mil.

Step 3: Recirculate

In this example, 10 recirculation cycles were completed with no change in the concentration of constituents for all cycles to increase dispersion of objects. In other examples, more than 10 recirculation cycles may be completed with no change in the concentration of constituents. In other examples, less than 10 recirculation cycles may be completed with no change in the concentration of constituents.

Observations

In the example described above, generally, during cycles 1-2, the compound has a viscosity similar to neat external-phase; the bulk compound exhibited a smooth, glossy appearance.

In the example provided above, a marked increase in viscosity by cycle 3 signified an increase in the dispersion of objects. In this example, the nanotubes may have undergone disentanglement, creating smaller unit-sized bundles and potentially even single-unit structures. The increase in viscosity may be associated with an increase in surface area of nanotubes exposed to the surrounding medium.

Surface texture changed for cycles 8; the bulk compound exhibited a matte finish appearance with fiber-like structures visible, evidence of furthering the degree of dispersion compared to previous cycles resulting from the breakdown to smaller-unit-sized structures.

Silicone-Carbon Nanotube (CNT) Compound

Constituent Definitions

In another example, the internal-phase may be a filler (e.g. carbon nanotubes) having a concentration of about 3 wt. % (i.e. 3 parts) and the external-phase may be a liquid polymer (e.g. silicone) having a concentration of about 97 wt. % (i.e. 97 parts).

The concentration may be constant throughout processing, or it can be changed during processing. For instance, the compound could initially be prepared with 0.5 wt. %, and after several recirculation cycles, the concentration can be increased or decreased by adding nanotubes or diluting the compound with more external-phase material, respectively.

Procedure

Step 1: Prepare the Compound

In this exemplary procedure, the first step is to pre-mix the internal-phase into the external-phase for a duration of approximately 30 minutes. Mixing may occur in a mechanical mixer with a helical mixing element at a speed of 500 rpm.

Step 2: Form Film of Compound; Disperse in Compound

The second step is to form the film of the compound by adding the prepared compound to a rotating surface, for example at a flow rate of about 1 kg/min while the rotating surface is rotating at about 15,000 rpm.

Step 3: Recirculate (Cycles 1-8)

In some embodiments, compound collected from the rotating surface can be recirculated in eight recirculation cycles. in some embodiments eight recirculation cycles may result in no change in the concentration of constituents for all cycles to increase the dispersion of objects.

Observations

For instance, during cycles 1-3, the compound viscosity may be similar to neat external-phase; the bulk compound may exhibit a smooth, glossy appearance.

A marked increase in viscosity by cycle 5 may be signified by an increase in the dispersion of objects. At this stage of recirculation, the nanotubes, for example, may have undergone disentanglement, creating smaller unit-sized bundles and potentially even single-unit structures. The increase in viscosity may be associated with an increase in surface area of nanotubes exposed to the surrounding medium.

Surface texture may change for recirculation cycles 7; the bulk compound may exhibit a matte finish appearance with fiber-like structures visible, evidence of furthering the degree of dispersion compared to previous cycles resulting from the breakdown to smaller-unit-sized structures.

Step 4: Recirculate (Cycles 9-13)

In some embodiments, before commencing cycle 9, the nanotube, for example, concentration may be decreased to 2 wt. % by adding more external phase (i.e. dilution). The diluted compound was mixed again with the helical mixer for 30 minutes at 500 rpm. Dilution was completed to reduce the compound viscosity before further recirculating the compound since the subsequent cycles increase the viscosity further.

The systems and methods described herein have been used in the preparation of various sample compounds and formulations. Examples of which are provided below.

In another example, an internal-phase is a filler (i.e. carbon nanotubes) and an external-phase is a liquid polymer such as a vinyl ester, a polyurethane, polyol, polyester, or other thermosetting resin known in the art.

In another example, an internal-phase is an electrically conductive filler (i.e. carbon nanotubes, graphite, graphene, carbon black, silver flake/particles/nanowires, or other electrically conductive fillers known in the art, or a combination of conductive fillers thereof) and an external-phase is a liquid polymer.

In another example, an internal-phase is a thermally conductive filler (i.e. hexagonal boron nitride (hBN), boron nitride nanotubes (BNNT), aluminum oxide, or other thermally conductive fillers known in the art, or a combination of conductive fillers thereof) and an external-phase is a liquid polymer.

Epoxy-Based Systems—Static Control Coatings

In one example, a stepwise formulation of a static control coating using a carbon nanotube (CNT)-epoxy conductive concentrate (additive system) is described herein.

In this example, the static control coating includes a conductive CNT-epoxy conductive additive diluted into an epoxy carrier to a target concentration at which a target sheet resistance level was achieved.

Other components may be added to the formulation, such as: pigments to add decorative features (colorize) the coating; other resins and reactive diluents to adjust the formulation viscosity and/or leveling properties of the coating; defoaming agents to remove bubbles in the formulation before curing; and wetting agents to enhance the mixing and dispersion of particle in the formulation (e.g., conductive additives, pigments).

Formulation and Testing Conditions/Parameters

Epoxy-CNT Concentrate

In this example, the standard CNT concentration was 0.2 wt. % with a maximum CNT concentration of 1 wt. %. The carrier resin was bisphenol-A epoxy (Epon 828) ('bis-A') (viscosity=11,000-15,000 cP)

Ground Plane Definition

Herein, "Ground Plane" refers to a condition of the substrate on which the static control coating is applied. For instance, a Non-Conductive Ground Plane refers to a static control coating applied over a non-conductive epoxy coating and a Conductive Ground Plane refers to a static control coating applied over a conductive epoxy coating (approx. $10^4$ ohm/sq).

Baseline Formulation

In this example, the epoxy-CNT concentrate (at 0.01 wt. % CNT) was diluted in bis-A epoxy and cast as an 8-mil (200 μm) or 16-mil (400 μm) wet-film thickness coating over a non-conductive or conductive ground plane. Unless otherwise specified, all thicknesses reported below are wet-film thicknesses.

Sample Preparation Conditions (Unless Otherwise Specified)

Modifications are reported relative to the Baseline Formulation. Component/constituent percentages: expressed as wt. % in the total formulation (Parts A & B). The curing agent used was EPIKURE 3370 (cycloaliphatic) (38:100 curing agent:resin ratio). The Ground Plane was non-conductive or conductive, the coating thickness was 8-mil (approx. 200 μm) or 16-mil (approx. 400 μm) and the letdown/dilution resin was bis-A (Epon 828).

Sheet Resistance Measurement Conditions were measured using megohmmeter (model Ohm-Stat® RT-1000) with a methodology of point-to-point (P2P) measurements, 10 DCV (for resistance $<10^6$ ohm/sq) or 100 DCV (for resistance $>10^6$ ohm/sq).

Results

Table 1 below shoes the effect of formulation components on coating performance for epoxy-based systems.

TABLE 1

| Sheet Resistance Performance Range | | | | |
|---|---|---|---|---|
| | Non-Conductive Ground Plane | | Conductive Ground Plane | |
| Thickness MWNT (wt. %) | 8-mil | 16-mil | 8-mil | 16-mil |
| | Sheet Resistance (ohm/sq) | | | |
| 0.2 | 2.68E+04 | 2.25E+04 | | |
| 0.145 | 5.51E+04 | | | |
| 0.1 | 2.47E+05 | 3.77E+05 | | 1.65E+05 |
| 0.05 | 5.01E+05 | 7.19E+05 | | 2.54E+05 |
| 0.01 | 1.64E+07 | 4.75E+06 | 6.46E+05 | 1.49E+06 |
| 0.005 | 1.79E+08 | 1.65E+08 | 1.07E+08 | 3.09E+06 |
| 0.002 | 8.42E+10 | 3.68E+11 | 1.09E+12 | 5.94E+09 |
| 0.001 | 3.01E+11 | 4.92E+11 | >2E12 | 1.52E+11 |

TABLE 2

| | Non-Conductive Ground Plane | | Conductive Ground Plane | |
|---|---|---|---|---|
| | 8-mil | 16-mil | 8-mil | 16-mil |
| Static Dissipative Regime | | | | |
| MWNT (wt. %) | 0.01 | 0.006 | 0.05 | 0.006 |
| Resistance (ohm/sq) | 1.6E7 | 2E7 | 2E7 | 2E7 |
| Conductive Regime | | | | |
| MWNT (wt. %) | 0.05 | 0.05 | 0.03 | 0.01 |
| Resistance (ohm/sq) | 5E5 | 7E5 | 2.5E5 | 6.4E5 |

As shown in Tables 1 and 2, popular static dissipative regime properties (1E6-1E9, more specifically 1E6-3.5E7 ohm/sq) can be obtained at <0.01 wt. % CNT. Popular conductive regime properties (1E4-1E6) can be obtained at >0.01 wt. % CNT.

Effect of Resin Blending

In this example, the test conditions used were as follows:

Bis-A viscosity=11,000-15,000 cP

Bisphenol-F resin: Epon 862 ('bis-F'); lower viscosity than Bis-A (viscosity=2,500-4,500 cP)

Bis-A:Bis-F ratio (1:1)

TABLE 3

| | Resistance (ohm/sq) | |
|---|---|---|
| Resin Blend for Dilution | 8 mil | 16 mil |
| Bis-A only (Baseline Formulation) | 1.6E7 | 4E6 |
| a) Bis-F only | 2E7 | 3E7 |
| b) Dilute in bis-A then bis-F | 2.3E7 | 1.4E7 |
| c) Dilute in bis-F then bis-A | 5.3E8 | 2.1E7 |
| d) Bis-A/bis-F/Baseline Formulation blend all together | 2.2E7 | 8E6 |
| e) Preblend bis-A/bis-F | 1.7E7 | 1.3E7 |

Referring to Table 3, tests (b), (d), (e) show a marginal impact on the sheet resistance at 8-mil thickness which indicates that the viscosity of the bis-F is sufficiently high to ensure adequate homogenization and dispersion of the CNTs during dilution that the order of which resin to diluent in first (bis-A vs. bis-F) is less critical to maintain sheet resistance. However, as the coating thickness increases to 16-mil, it is preferential to dilute in the higher viscosity resin first (Test b) or pre-blend the resins together first before letdown (Test e).

Test (c) shows that if diluting in two distinctly different viscosity resins, then it is less preferential to dilute in the low viscosity resin first (bis-F), due to sub-optimal dispersion in the low viscosity medium, and then diluting in the higher viscosity resin (bis-A).

Test (a) shows that if only diluting in single resin and not blending, the bis-F dispersion is satisfactory to ensure adequate dispersion and homogenization of the CNTs during dilution at 8-mil, although the resistance increases in a thicker 16-mil coating which is believed to be more stratification in the CNT dispersion through the thickness due to the lower viscosity resin providing less stabilization to the CNT network.

Effect of Reactive Diluent

In this example, the test conditions were as follows:

Air Products Epodil 759: monofunctional reactive diluent very low viscosity (8 cP) compared to Bis-A (11,000-15,000 cP)

Bis-A: Epodil 759—represents the ratio of bis-A to reactive diluent as the dilution phase

TABLE 4

| Reactive Diluent | Resistance (ohm/sq) 8 mil |
|---|---|
| none (Baseline Formulation) | 1.6E7 |
| a) bis-A:Epodil 759 (85:15) | 2E9 |
| b) bis-A:Epodil 759 (95:5) | 2.2E7 |
| c) bis-A:Epodil 759 (85:15) | 8.5E7 |

Referring to Table 4, Test (a) shows that performing the dilution by mixing bis-A, the reactive diluent, and the Baseline Formulation all together at once is not a preferred approach. Since the viscosity of the reactive diluent is very low, it is believed the homogeneity of the dispersion once letdown is not satisfactory, evidenced by the 125× increase in sheet resistance.

Test (b) shows that a preferred approach is to dilute the Baseline Formulation in the bis-A first, a much higher viscosity medium to ensuring adequate dispersion of the CNTs, then diluting in the reactive diluent. Reducing the reactive diluent concentration to 5% of the total dilution ratio also maintains a higher overall formulation viscosity, further ensuring adequate dispersion of the CNTs, evidenced by 1.4× increase in resistance.

Test (c), using the same approach as Test (b) (dilute in Bis-A first then the reactive diluent) but with the same reactive dilute ratio to bis-A as Test (a) (15%), indicates this approach is preferred as the sheet resistance only increases 5.3×; the results also indicate that the lower reactive diluent content in Test (b) exhibits the lowest impact on increasing sheet resistance, which is believed to linked to a higher formulation viscosity is preferred for optimal dispersion of the CNTs.

Effect of Coloration—Unpigmented vs. Pigmented

In this example, the test conditions were as follows:

Pigment: titanium dioxide ('TiO2') (white color)

TABLE 5

| Pigmentation | Resistance (ohm/sq) 8 mil | 16 mil |
|---|---|---|
| none (Baseline Formulation) | 1.6E7 | 4E6 |
| 5% $TiO_2$ | 1.7E7 | 1.2E7 |
| 10% $TiO_2$ | 3.5E7 | 2.2E7 |

Referring to Table 5, the unpigmented coatings appeared optically clear whereas the pigmented coatings had a white-gray color and were brighter with higher pigment tint added.

Effect of $TiO_2$ on resistance—marginal impact at 8-mil (marginal at 5% $TiO_2$ and only 2× increase in resistance at 10% $TiO_2$; greater impact on resistance with increase in film thickness to 16-mil).

Competitor Comparisons—ATO and SWNTs

Competitor Products tested included Merck Iriotec 7325: antimony tin oxide ('ATO') conductive additive (physical form: powder) and OCSiAl CompE: single-walled nanotube ('SWNT') epoxy conductive additive (physical form: concentrated paste).

Unpigmented

TABLE 6

| ATO (wt. %) | Dilution Resin | Resistance (ohm/sq) 8 mil | 16 mil |
|---|---|---|---|
| Baseline Formulation | bis-A only | 1.6E7 | 4E6 |
| 25% IRIOTEC 7325 | bis-A only | 7.1E9 | 1.4E9 |
| 30% IRIOTEC 7325 | bis-A only | 9.4E8 | |
| 25% IRIOTEC 7325 | bis-F only | 2.4E7 | 6.6E7 |
| 30% IRIOTEC 7325 | bis-F only | 2.1E7 | 3E7 |
| 25% IRIOTEC 7325 | pre-blend bis-A/bis-F | 9.7E8 | 3.8E9 |

Referring to Table 6, due to the high concentration of ATO required, achieving $10^7$ ohm/sq resistance was only achievable with a lower viscosity formulation to achieve resistance in the $10^7$ regime. 25-30 ATO wt. % (5-6× higher) concentration was required to achieve sheet resistance similar to epoxy-CNT system.

At corresponding resistance levels (above), ATO is opaque with green-blue color tones, whereas the epoxy-CNT system is transparent.

TABLE 7

| CompE (wt. %) | SWNT (wt. %) | Resistance (ohm/sq) 8 mil |
|---|---|---|
| 28.57 | 0.2 | 2E+06 |
| 14.29 | 0.1 | 5.5E+06 |
| 7.14 | 0.05 | 2.6E+07 |
| 1.43 | 0.01 | 5.8E+08 |
| 0.71 | 0.005 | 9.4E+09 |
| 0.29 | 0.002 | 2.9E+11 |
| 0.14 | 0.001 | 3.6E+11 |

TABLE 8

| CNT (wt. %) | Resistance (ohm/sq) Epoxy-CNT System* | CompE |
|---|---|---|
| 0.01 | 1.6E7 (36×) | 5.8E8 |
| 0.05 | 5E5 (52×) | 2.6E7 |
| 0.2 | 2.7E4 (75×) | 2E6 |

*numbers in parentheses represent number of times lower resistance of epoxy-CNT system to CompE Referring to Tables 7 and 8, CompE exhibited 36×-75× higher resistance than the epoxy-CNT system at matching nanotube concentrations.

At corresponding resistance levels (above), CompE exhibited dark color tones, whereas the epoxy-CNT system is transparent.

Pigmented

At similar resistances levels, the epoxy-CNT system appears brighter, with white-gray color tones, whereas CompE exhibits darker black color masking and ATO exhibits pastel green-blue tones.

At a resistance level of approx. $1\text{-}2\times10^7$ ohm/sq in an unpigmented coating, the epoxy-CNT system and CompE exhibit no change with the addition of up to 5% $TiO_2$ pigment, whereas ATO exhibits an increase in resistance of $10^4$ times.

Defoaming Agent

In this example, the test conditions were as follows:

Defoaming agents: BYK BYK535 and BYK008

TABLE 9

| Defoaming Agent | Resistance (ohm/sq) 8 mil |
|---|---|
| none (Baseline Formulation) | 1.6E7 |
| 0.1% BYK535 | 1.5E10 |
| 1% BYK535 | 3.7E11 |
| 0.1% BYK088 | 2E7 |
| 0.5% BYK088 | 4.4E7 |
| 1% BYK088 | 7.7E7 |
| 2% BYK088 | 6E7 |

Referring to Table 9, sheet resistance appears to be sensitive to the selection and concentration of defoaming agent. For instance, BYK535 appears to adversely affect the sheet resistance, increasing it greater than 600× for concentrations from 0.1-1 wt. %. BYK088 appears to be a preferred agent, only marginally increasing the sheet resistance by 2.7× up to 0.5 wt. %.

Wetting Agent

TABLE 10

| Wetting Agent | Resistance (ohm/sq) 8 mil |
|---|---|
| none (Baseline Formulation) | 1.6E7 |
| 0.1% BYK392 | 4.5E9 |
| 0.5% BYK392 | 6.6E10 |
| 1% BYK392 | 7.1E10 |
| 1% BYK306 | 4.6E7 |
| 1% BYK106 | 2.4E7 |
| 1% BYK2155 | 2.7E7 |

Referring to Table 10, current results indicate sheet resistance is sensitive to wetting agents. Even a small concentration (0.1 wt. %) appears to increase the resistance greater than 280× compared to the Baseline Formulation. Unlike BYK392, other wetting agents, such as BYK306, BYK106, and BYK2155 do not appear to have such an adverse effect on the sheet resistance of the coating.

Pigment Pack vs. Powder Grind

In this example, the test conditions were as follows:

Pigment pack—commercially available pigment powder (titanium dioxide) preblended in an epoxy resin Pigment pack: Chromaflo White

TABLE 11

| Pigmentation Method | Resistance (ohm/sq) 8 mil | 16 mil |
|---|---|---|
| 5% $TiO_2$ | 1.7E7 | 1.2E7 |
| 6% $TiO_2$ in pigment pack* | 2.7E10 | 2.6E10 |

*the loading of pigment pack corresponds to a 6% pigment particle load

Pigment packs can be formulated with other formulation components, such as wetting agents, as the results have shown above, such formulation components can have an adverse effect on the sheet resistance (often, the formulations of pigment packs are also proprietary, so the formulation components may be unknown).

Directly mixing the pigment particles, and adding other formulation components such as wetting agents and/or defoaming agent separately at the formulator's choosing, is preferential to maintain low sheet resistance.

Silicone-CNT System

Electrical and mechanical properties of carbon nanotube (CNT)-silicone conductive concentrates have been performed (as described below) and the results are provided below.

Formulation and Testing Conditions/Parameters

Silicone-CNT Concentrate had a maximum CNT concentration of 3 wt. % and the carrier resin was a two-parts room temperature vulcanize (RTV) vinyl silicone rubber (Momentive RTV615) (viscosity=4,300 cP).

Sample Preparation Conditions (Unless Otherwise Specified)

CNT percentages below are expressed as wt. % in Part A; the letdown/dilution resin is the same as the Part A carrier resin material (RTV 615) is described therein.

Volume Resistivity Measurement Conditions

The instrument used for these examples was a 4-point Agilent LCR meter, model E4980A and the methodology used was cast and cured strip, 3 mm thickness.

Viscosity Measurement Conditions

The instrument used for these examples was a Standard Malvern-Bohlin controlled stress/strain rheometer (20 mm plate diameter, 1 mm gap) and the methodology used for viscosity measured as a function of shear rate at 10 $s^{-1}$.

Results

Volume Resistivity/Conductivity Range

TABLE 12

| MWNT (wt. %) | Conductivity (S/m) | Volume Resistivity (ohm · cm) | Viscosity @ 10 $s^{-1}$ (Pa · s) |
|---|---|---|---|
| 0.05 | 0.5 | 192.31 | 5.3 |
| 0.10 | 2.5 | 40.00 | 6.5 |
| 0.20 | 6.6 | 15.15 | 8.8 |
| 0.5 | 23.2 | 4.31 | 23 |
| 1.0 | 56.1 | 1.78 | 54.9 |
| 1.5 | 88.5 | 1.13 | 186 |
| 2.0 | 155.4 | 0.64 | 983 |
| 2.5 | 186.4 | 0.54 | 1260 |
| 3.0 | 210.2 | 0.48 | 2780 |

Use Cases

In some embodiments, the epoxy-CNT concentrate, silicone-CNT concentrate, vinyl ester-CNT concentrate, polyurethane-CNT concentrate, polyester-CNT concentrate, or other thermoset-CNT concentrate described may be used as a: static control coating, a static dissipative or conductive, applied on a conductive or non-conductive ground plane; applied as a clear coat or a decorative (colorized) coating; used as the primer layer or top coat.

In some embodiments, the epoxy-CNT concentrate, silicone-CNT concentrate, vinyl ester-CNT concentrate, polyurethane-CNT concentrate, polyester-CNT concentrate, or other thermoset-CNT concentrate described may include other formulation components.

In some embodiments, the epoxy-CNT concentrate, silicone-CNT concentrate, vinyl ester-CNT concentrate, polyurethane-CNT concentrate, polyester-CNT concentrate, or other thermoset-CNT concentrate described may be used as flooring such as but not limited to decorative protective flooring.

In some embodiments, the epoxy-CNT concentrate, silicone-CNT concentrate, vinyl ester-CNT concentrate, polyurethane-CNT concentrate, polyester-CNT concentrate, or other thermoset-CNT concentrate described may be used in the aerospace industry such as but not limited to in fuel system protection, edge glow, or lightning strike protection.

In some embodiments, the epoxy-CNT concentrate, silicone-CNT concentrate, vinyl ester-CNT concentrate, polyurethane-CNT concentrate, polyester-CNT concentrate, or other thermoset-CNT concentrate described may be used in automotive applications such as but not limited to body panel painting and lighting systems.

In some embodiments, the epoxy-CNT concentrate, silicone-CNT concentrate, vinyl ester-CNT concentrate, polyurethane-CNT concentrate, polyester-CNT concentrate, or other thermoset-CNT concentrate described may be used in power systems such as but not limited to as semi-conductive/conductive layers and coatings to distribute electrical stress within high voltage cable connectors, as joints/terminations, as insulation/screening layers, and as insulators.

In some embodiments, the epoxy-CNT concentrate, silicone-CNT concentrate, vinyl ester-CNT concentrate, polyurethane-CNT concentrate, polyester-CNT concentrate, or other thermoset-CNT concentrate described may be used as electroactive polymers such as but not limited to as actuators or sensors; examples including electrodes of a flexible, stretchable capacitive motion sensors embedded in textiles to track movement for fitness apparel, medical device monitoring systems, gaming systems, and the like; and as actuators for printable speakers.

In some embodiments, the epoxy-CNT concentrate, silicone-CNT concentrate, vinyl ester-CNT concentrate, polyurethane-CNT concentrate, polyester-CNT concentrate, or other thermoset-CNT concentrate described may be used in stereolithography (SLA) 3D printing, RFID, printed electronics, wood finishes, smart packaging labels and the like.

In some embodiments, the epoxy-CNT concentrate, silicone-CNT concentrate, vinyl ester-CNT concentrate, polyurethane-CNT concentrate, polyester-CNT concentrate, or other thermoset-CNT concentrate described may be used as solar panels, conductive adhesive, heads up displays, sensors such as but not limited to pressure sensors, strain gauges, etc., printed electronics, printable electronics such as but not limited to printable circuits in textiles and footwear to enable unique (LED) lighting circuits or anti-static protection, zebra connectors such as but not limited to flexible, conductive elastomeric connectors; commonly used for LCD connectors, thermoelectric heaters such as but not limited to heaters embedded into textiles, automotive seats, footwear, electronic devices, window coatings and the like, safety vests for electricians to dissipate shock, rubber keypads and membrane switches, conductive gaskets and sealants, EMI/RFI shielding, anti-static tubing, anti-static footwear, to enhance electrical properties (i.e. anti-static, conductive) of gelcoats, bulk moulding compound (BMC), sheet moulding compound (SMC), anti-static packaging anti-static foam and microwave absorption.

Silicone System

According to some embodiments, a silicone-CNT concentrate is disclosed here. The silicone-CNT concentrate may have a concentration in a range of about 3 wt. %.

In some embodiments, the silicone-CNT concentrate includes a carrier resin. In some embodiments the carrier resin may include two parts. For instance, the carrier resin may include a Part A and a Part B. For instance, Part A of the carrier resin may include a polymer, an inhibitor and a catalyst. In some embodiments, the polymer is a liquid polymer such as a vinyl polymer. In some embodiments, the Part A is 99.85 parts vinyl polymer (e.g., Andisil VS1000, AB Specialty Silicones LLC); 0.1 parts inhibitor (e.g., Andisil 2827-186L, AB Specialty Silicones LLC); 0.05 parts platinum catalyst (e.g., 1% Pt Karstedt in 1,000 cS vinyl terminated polydimethylsiloxane, Johnson Matthey)

In some embodiments, the Part B includes a cross-linker. For instance, the Part B may include 2 parts cross linker (e.g., Andisil XL10, AB Specialty Silicones LLC).

The following Volume Resistivity Measurement test results were obtained using the Van der Pauw method with cured films thicknesses of 160 μm and 2 mm. Instrumentation used for applying the Van der Pauw method included apparatus components consist of the following: power supply (HP 6210B) constant current source to sample through electrodes; Digital multimeter (Keithley 197A) for measuring current; Digital multimeter (Tektronix DMM 4020) for measuring potential drop across electrodes.

Sheet Resistance Measurement Conditions

The following sheet resistance measurements were made using a megaohm meter (model Ohm-Stat® RT-1000). The methodology used included point-to-point (P2P) measurements, 10V (resistance $<10^6$ ohm/sq), 100V (resistance $>10^6$ ohm/sq); non-conductive ground plane; 380 μm film thickness.

The viscosity measurements reported below were obtained using a standard Malvern-Bohlin controlled stress/strain rheometer (20 mm plate diameter, 1 mm gap). Viscosity was measured as a function of shear rate at 10 $s^{-1}$.

These results are shown in Table 13.

TABLE 13

| CNT (wt. %) | Volume Resistivity (ohm · m) | Sheet Resistance (ohm/sq) | Viscosity @ 10/s (Pa · s) |
|---|---|---|---|
| 0.05 | 4.26 | 26,600 | 5.26 |
| 0.10 | 2.61 | 17,408 | 6.50 |
| 0.5 | 0.15 | 959 | 22.89 |
| 1.0 | 0.024 | 150 | 54.9 |
| 2.0 | 0.009 | 59 | 983 |
| 3.0 | 0.004 | 28 | 2780 |

Competitor Comparisons—Single-Walled Nanotube (SWNT) and Carbon Black (CB)

Competitor Products used for comparison included: OCSiAl Matrix 601: single-walled nanotube ('SWNT') liquid silicone rubber conductive compound (physical form: concentrated paste) (approx. 10 wt. % SWNT); Wacker Powersil 466 AB: carbon black ('CB') liquid silicone rubber conductive compound (physical form: concentrated paste) (approx. 5 wt. % CB) and Wacker Elastosil 570-70: carbon black ('CB') high consistency silicone rubber conductive compound (physical form: gum) (approx. 30-40 wt. % CB).

These results are shown in Table 14.

TABLE 14

| | | Volume Resistivity (ohm · m) | | | |
|---|---|---|---|---|---|
| CNT (wt. %) | | 0.10 | 0.5 | 2.0 | 3.0 |
| Silicone-CNT System | 160 μm thick | 2.61 | 0.15 | 0.009 | 0.004 |
| | 2 mm thick | 0.42 | 0.06 | 0.011 | 0.008 |
| OCSiAl Matrix 601 (160 μm thick) | | 159 (61×) | 0.25 (2×) | 0.024 (3×) | 0.032 (8×) |

TABLE 14-continued

| CNT (wt. %) | Volume Resistivity (ohm · m) 0.10 | 0.5 | 2.0 | 3.0 |
|---|---|---|---|---|
| Wacker Powersil 466 AB (160 μm thick) | | | | 1.39 (347×) |
| Wacker Elastosil 570-70 (2 mm thick) | | | | 0.04 (6×) |

The volume resistivity of the CNT-silicone system disclosed herein appears to be up to 61 times lower (i.e. more conductive) than the Matrix 601 product at matching nanotube concentrations.

The volume resistivity of the CNT-silicone system disclosed herein appears to be 6 times and 347 times lower (i.e. more conductive) than Powersil 466 and Elastosil 570-70, respectively at each product's maximum carbon weight percentage.

Effect of Stretching on Sheet Resistance

For this example, a different carrier and letdown resin was used for the CNT-silicone system:

Carrier Resin: two-part room temperature vulcanize (RTV) vinyl silicone rubber (e.g., Momentive RTV615, viscosity=4,300 cP).

TABLE 15

| | Sheet Resistance (ohm/sq) 0% elongation | 100% elongation | change in resistance while stretching | 100% elongation, repeatability |
|---|---|---|---|---|
| Silicone-CNT System | $2.59 \times 10^4$ | $2.52 \times 10^5$ | 10× | 80% |
| OCSiAl Matrix 601 | $4.73 \times 10^4$ (2×) | $2.85 \times 10^6$ (11×) | 60× | 66% (1.2×) |
| Wacker Powersil 466 AB | $4.51 \times 10^3$ (0.2×) | $2.44 \times 10^7$ (97×) | 5399× | 13% (6.4×) |

Samples for the products of Table 15 were prepared with similar sheet resistance at 0% elongation; in fact, the Powersil 466 product has a lower sheet resistance (more conductive) than the silicone-CNT system.

When the three samples are stretched to 100% elongation, the silicone-CNT system exhibits 11× and 97× lower sheet resistance (more conductive) compared to the Matrix 601 and Powersil 466 products, respectively.

This result indicates that the CNT-silicone system provides a more robust percolation network while undergoing deformation (e.g., stretch, bending, twisting) compared to the other two products. This is a result of the highly dispersed and high-aspect-ration nanotube microstructure in the CNT-silicone system.

It should be noted that volume resistivity data are reported and compared at matching carbon weight percentages.

It should be noted that numbers in parenthesis indicate the multiple times greater conductivity of silicone-CNT system over comparison product at matching carbon weight percentages, unless otherwise specified.

It should be noted that Volume resistivity/sheet resistance data reported at the maximum carbon weight percentage for each respect product.

It should be noted that the Silicone-CNT system (0.1 wt. % CNT) was compared at a matching sheet resistance to the comparison products, unless otherwise specified.

It should be noted that numbers in parenthesis indicate the multiple times greater performance of silicone-CNT system over comparison product.

It should be noted that sheet resistance measurement methodology: megohm meter, P2P, 10V ($<10^6$ ohm/sq), 100V ($>10^6$ ohm/sq); non-conductive ground plane.

It should be noted that sheet resistance of cast was 380 μm thick film.

While the above description provides examples of one or more apparatus, methods, or systems, it will be appreciated that other apparatus, methods, or systems may be within the scope of the claims as interpreted by one of skill in the art.

The invention claimed is:

1. A method for mixing and dispersing an internal phase and an external phase in a liquid compound, the method comprising:

preparing the liquid compound by combining the internal phase of the compound and the external phase of the compound, the internal phase comprising carbon nanotubes and the external phase being a liquid comprising a polymer;

depositing the liquid compound onto a rotating surface;

forming a film of the liquid compound on the rotating surface as the rotating surface rotates, the internal phase of the liquid compound and the external phase of the liquid compound dispersing within the film on the rotating surface; and collecting the film as a bulk, dispersed liquid compound on a collection surface.

2. The method of claim 1 further comprising the steps of, after the step of forming the film of the liquid compound on the rotating surface:

forming liquid compound projectiles from the film of the liquid compound; and collecting the liquid compound projectiles on the collection surface.

3. The method of claim 2, wherein the step of forming the liquid compound projectiles from the film of the liquid compound comprises forming at least one of liquid ligaments and liquid compound-film projectiles.

4. The method of claim 3, wherein the step of forming the liquid compound projectiles from the film of the liquid compound comprises forming liquid ligaments at an edge of the rotating surface.

5. The method of claim 2, wherein the step of collecting the liquid compound projectiles includes collecting the liquid compound projectiles on a collection surface oriented to be transverse to the rotating surface.

6. The method of claim 1, further comprising the step of, after the step of forming the film of the liquid compound on the rotating surface:

depositing at least one of additional internal phase of the liquid compound and additional external phase of the liquid compound onto the rotating surface.

7. The method of claim 1, wherein the liquid compound has a concentration of carbon nanotubes in a range of about 0.2 to about 5 wt. %.

8. The method of claim 1, wherein the internal phase of the liquid compound comprises a thermally conductive filler.

9. The method of claim 8, wherein the thermally conductive filler includes one or more allotropes of carbon, hexagonal boron nitride (hBN), boron nitride nanotubes (BNNT) and aluminum oxide, aluminum hydroxide, zinc oxide, and silicon carbide.

10. The method of claim 1, wherein the liquid polymer comprises one of a vinyl ester, a polyurethane, a polyol, a polyester, liquid polybutadiene (BR), liquid ethylene propylene diene terpolymer (EPDM), liquid isoprene (IR) and liquid fluoroelastomer KFM.

11. The method of claim 1, wherein the liquid polymer is an epoxy-based polymer.

12. The method of claim 1, wherein the liquid polymer is a silicone-based polymer.

13. The method of claim 1, wherein the step of depositing the liquid compound includes depositing a first volume of the liquid compound on the rotating surface at a flow rate of about 1 kg/min while the rotating surface is rotating at about 15,000 rpm.

14. The method of claim 1 further comprising, after collecting the film as a dispersed liquid compound on the collection surface, recirculating the collected liquid compound and depositing the recirculated liquid compound on the rotating surface.

* * * * *